US007050035B2

(12) United States Patent
Iisaka

(10) Patent No.: US 7,050,035 B2
(45) Date of Patent: May 23, 2006

(54) DRIVE METHOD OF AN ELECTRO-OPTICAL DEVICE, A DRIVE CIRCUIT AND AN ELECTRO-OPTICAL DEVICE AND ELECTRONIC APPARATUS

(75) Inventor: Hidehito Iisaka, Shiojiri (JP)

(73) Assignee: Seiko Epson Corporation, Tokyo (JP)

( * ) Notice: Subject to any disclaimer, the term of this patent is extended or adjusted under 35 U.S.C. 154(b) by 317 days.

(21) Appl. No.: 10/299,844

(22) Filed: Nov. 20, 2002

(65) Prior Publication Data

US 2003/0137499 A1 Jul. 24, 2003

(30) Foreign Application Priority Data

Dec. 11, 2001 (JP) ..... 2001-377300

(51) Int. Cl.
*G09G 3/36* (2006.01)

(52) U.S. Cl. ..... 345/99; 345/690; 345/691; 315/169.1; 349/77; 349/83

(58) Field of Classification Search ..... 345/55, 345/60, 63, 68, 89, 100, 103, 204, 210, 690, 345/691, 99; 315/169.1; 349/77, 83
See application file for complete search history.

(56) References Cited

U.S. PATENT DOCUMENTS

| | | | | |
|---|---|---|---|---|
| 5,581,406 | A * | 12/1996 | Kobayashi et al. | 359/604 |
| 5,642,133 | A * | 6/1997 | Scheffer et al. | 345/690 |
| 5,757,343 | A * | 5/1998 | Nagakubo | 345/63 |
| 6,014,258 | A * | 1/2000 | Naka et al. | 359/618 |
| 6,232,938 | B1 * | 5/2001 | Tsuchida et al. | 345/88 |
| 6,414,658 | B1 * | 7/2002 | Tokunaga | 345/63 |
| 6,549,180 | B1 * | 4/2003 | Yoo et al. | 345/60 |
| 6,703,991 | B1 * | 3/2004 | Salters et al. | 345/63 |

* cited by examiner

*Primary Examiner*—Amr A. Awad
*Assistant Examiner*—Vincent E. Kovalick
(74) *Attorney, Agent, or Firm*—Oliff & Berridge, PLC

(57) ABSTRACT

A display provided to reduce flicker by a driving method of using a sub field drive.

One field is divided into plural sub fields on a time axis, each of which is a control unit to drive a pixel. A code storing ROM stores a code to give a sub field drive pattern based on display data. With respect to adjacent pixels within a control area, a data encoder writes pixel data by using a sub field drive pattern read from the code storing ROM and a pattern delayed by the predetermined sub field period. Hence, adjacent pixels are driven by different sub fields drive patterns each other so that timing of flickering among adjacent pixels is differentiated.

19 Claims, 13 Drawing Sheets

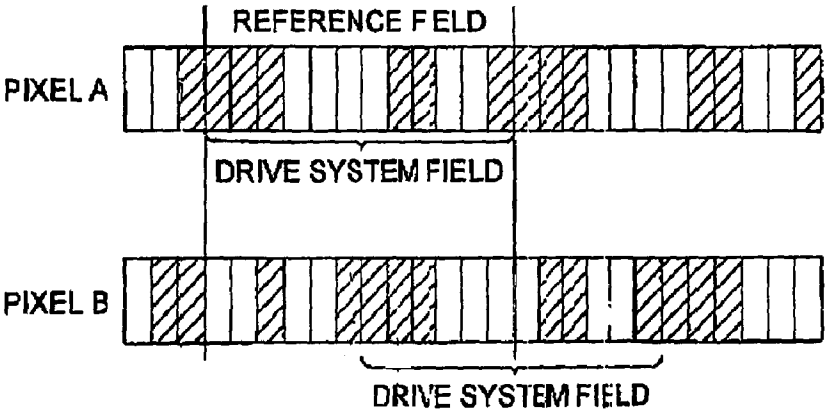
FIG.9A
FIG.9B
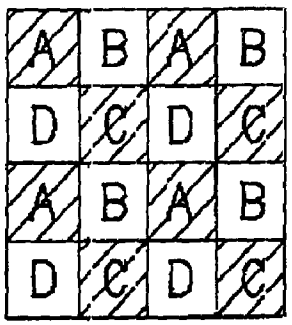
FIG.10

FIG.13A
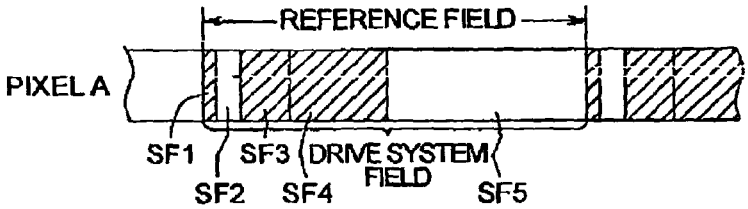
FIG.13B
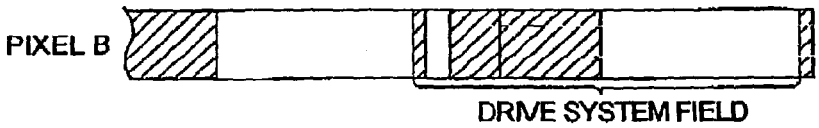
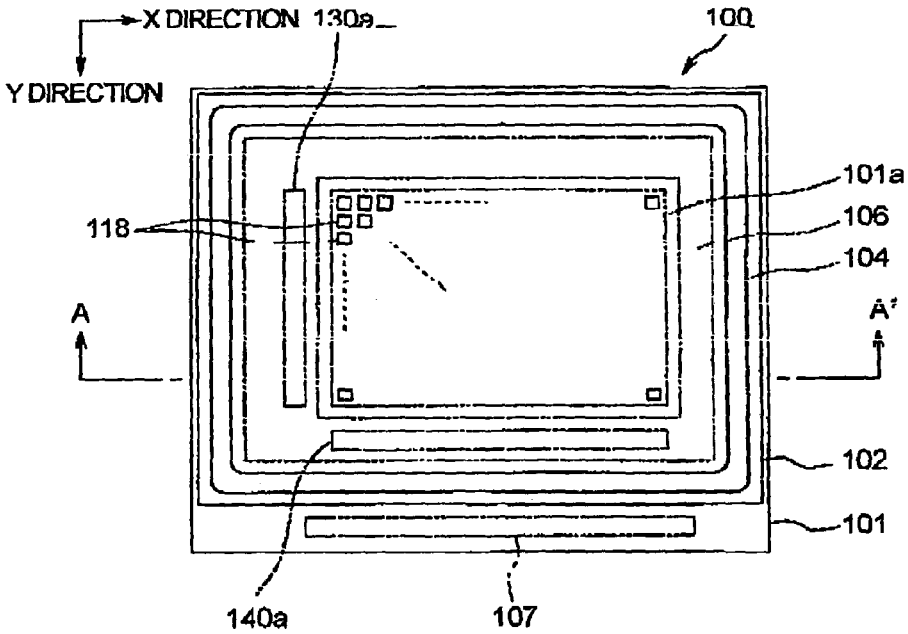
FIG.14

DRIVE METHOD OF AN ELECTRO-OPTICAL DEVICE, A DRIVE CIRCUIT AND AN ELECTRO-OPTICAL DEVICE AND ELECTRONIC APPARATUS

BACKGROUND OF THE INVENTION

1. Field of the Invention

The prevent invention relates to a method of driving an electro-optical device where gray-scale display is controlled by a sub field-drive method, a drive circuit and an electronic apparatus thereof.

2. Description of Related Art

An electro-optical device, such as a liquid crystal display using liquid crystal as electro-optical material, for example, is widely utilized as a display portion of various kinds of information apparatus, and a liquid crystal TV and so on, as a display device that can replace a cathode ray tube (CRT).

Such liquid crystal display device, for example, includes pixel electrodes arranged in a matrix, an element substrate including switching elements, such as TFT (Thin Film Transistor) connected to those pixel electrodes, an opposite substrate, including an electrode opposite to each of the pixel electrodes, an opposite substrate, including an electrode opposite to each of the pixel electrodes and liquid crystal as electro-optical material filled between these substrates.

A display mode of such a liquid crystal display device includes a normally white mode where a white image is displayed without voltage, and a normally black mode where a black image is displayed without voltage.

Next, an operation for displaying gray-scale of an image with a liquid crystal display device is explained.

A switching element is turned on by a scanning signal supplied via a scanning line. An image signal in response to gray-scale is applied to a pixel electrode via a data line in the state where the switching element is in an on-state by applying the scanning signal. Then, an amount of electric charge in response to voltage of the image signal is accumulated between the pixel electrode and an opposite electrode. This state of electric charge accumulation can be maintained in each electrode by the capacity nature of a liquid crystal layer and storage capacitance after accumulating electric charge, even if the switching element is in an off state by removing the scanning signal.

Hence, the orientation state of liquid crystal can be changed for every pixel by driving each of the switching elements and controlling the amount of accumulated electric charge in response to gray-scale, so that transmittance ratio of light is changed and brightness can be changed for every pixel. Thus, it is possible to realize a gray-scale display.

In consideration of the capacitive nature of the liquid crystal layer and of storage capacitance, it is preferable that electric charge is applied to the liquid crystal layer of each pixel only during a part of a period. Therefore, when plural pixels arranged in a matrix are driven, the scanning signal is applied to pixels connected each other on the same scanning line simultaneously and the image signal is applied to each pixel via a data line. The scanning line for supplying an image signal is switched sequentially. Namely, in the liquid crystal display device, it is possible to attain time-shaping multiplex drive when the scanning line and the data line are shared commonly for plural pixels.

However, the image signal applied to the data line is voltage in response to gray-scale, namely analog signal. Hence, an overall apparatus is highly expensive since an analog circuit or an operational amplifier is necessary for a peripheral circuitry of an electro-optical device. In addition, non-uniformity on display quality occurs due to characteristics of these analog circuit and operational amplifier and/or irregularity of wiring resistance, so that it is difficult to maintain high quality displaying. Especially, these problems become serious in case of displaying a fine and accurate image.

SUMMARY OF THE INVENTION

In order to overcome the above-mentioned problems, a sub field driving system to drive a pixel with digital approach is suggested for an electro-optical device, such as a liquid crystal display. In the sub field driving system, one field is divided into plural sub fields on a time axis and on-state voltage or off-state voltage is applied to every pixel in response to gray-scale. Further, in the sub field driving system, the level of voltage applied to a liquid crystal is not changed and voltage applied to liquid crystal is changed by varying time to apply voltage pulses to liquid crystal instead, so that transmittance ratio of liquid crystal panel is controlled thereby. Hence, the levels of voltage to drive liquid crystal are only binary digits of on-level and off-level.

In an analog drive, drive voltage is applied to the liquid crystal during a whole period of each field and a transmittance ratio is generally constant. On the other hand, in a sub field drive method; a sub field of applying on level to liquid crystal and sub field of applying off level, coexist in a field. Namely, blinking occurs in a field period if an image is not a completely black display or a completely white display. In particular, when sub fields of applying on level are concentrated in a part of a field period, black and white images are turned over by a cycle of ½ of one field period, so that flickering is remarkable.

In a case when such phenomenon occurs in every pixel unit, it is relatively rare that flickering is remarkable. However, since brightness among adjacent pixels is generally equal except a boundary part of a displayed image, a drive pattern of a sub field of applying on-level and a sub field of applying off-level within a field, is generally the same among these pixels. Hence, timing of blinking on each pixel is almost equal so that blinking is remarkable, and image deterioration due to flickering is also remarkable.

To address the above-mentioned problem, the present invention provides a drive method of the electro-optical device, a drive circuit and electronic apparatus which can reduce flickering by changing timing of blinking of each of the adjacent pixels so that image quality is enhanced.

A drive circuit for an electro-optical device of the present invention includes a display portion having pixels arranged in a matrix with electro-optical material, of which light transmittance ratio is changed by applying voltage, supplies on-voltage to make the light transmittance ratio be saturated, or off-voltage to make the light transmittance ratio be a non-transmissive state to the display portion, implements sub field drive to realize gray-scale display in response to the ratio of an optical transmissive state to a non-transmissive state of the electro-optical material per unit time and time ratio, and includes; a first pixel driving device, driving the pixel with each sub field as a unit of control that is formed by dividing a field into plural portions on a time axis, and driving the pixel located at a predetermined position in an image by a first sub field drive pattern that is an arranged pattern of a sub field of applying the off-voltage and a sub field of applying the on-voltage; and a second pixel driving device, driving the pixel with each sub field as a unit of control that is formed by dividing a field into plural portions on a time axis as a unit of control, and driving a pixel adjacent to the pixel located at the predetermined position in an image by at least one second sub field drive pattern differentiated from the first sub field drive pattern.

According to such structure, the light transmittance ratio of electro-optical material forming each pixel is changeable in response to applying voltage. The first and the second pixel drive device drives the pixel with a sub field as a control unit, that is formed by dividing a field into plural portions on a time axis, by applying on-voltage to make the light transmittance ratio be saturated, or off-voltage to make it be a non-transmissive state, to electro-optic material. The first pixel drive device drives the pixel located at a predetermined position in a displayed image with the first sub field drive pattern that is an arranged pattern of sub fields of applying on-voltage and sub fields of applying off-voltage to liquid crystal. The second pixel drive device drives the pixel adjacent to the pixel located at a predetermined position in a displayed image with at least one second sub field differentiated from the first the sub field drive pattern. Hence, the adjacent pixel is driven by a different sub field drive pattern so that on and off of the sub field within the same sub field period, do not coincide with each other easily. Hence, flickering can be reduced, since blinking of adjacent pixels by sub field drive is not remarkable.

In addition, the second pixel driving device drives a pixel adjacent to the pixel located at the predetermined position in an image with the second sub field drive pattern, by starting a sub field drive based on the first sub field drive pattern, by differentiating the start timing by term of integral multiple of a sub field period from start timing of the sub field drive to the pixel located at a predetermined position in an image by the first pixel driving device.

According to such structure, the second pixel drive device drives the pixel adjacent to the predetermined pixel by shifting the first sub field drive pattern by time of integral multiple of a sub field period. Hence, in the second sub field pattern, that differs from the first sub field pattern, timing of blinking among adjacent pixels is different.

In addition, the second sub field drive pattern is obtained by delaying the first sub field drive pattern by a predetermined number of sub field periods on a time axis.

According to such structure, the pixel adjacent to the predetermined pixel, can be driven by the second sub field drive pattern, utilizing the first sub field drive pattern without changing any kinds of signals for driving pixels.

In addition, the first and the second sub field drive patterns are stored by a memory.

According to such structure, the second sub field drive pattern can be obtained without any delay processing and any kinds of calculations toward the first sub field drive pattern.

In addition, the first and the second pixel driving devices drive the pixel by using the first and the second sub field drive patterns with a control area unit of the predetermined number of pixels.

According to such a structure, blinking of adjacent pixels can be reduced with unit of control area. Reducing flickering can be further improved by setting a control area.

In addition, the first and the second pixel driving devices set the period of a sub field to be shorter than saturation response time, when transmittance ratio of the electro optical material is saturated in response to the applied on-voltage.

According to such structure, saturation response time of electro-optical material is longer than time of one sub field so that the light transmittance ratio of electro-optical material can be varied more finely than the number of sub fields in one field. Hence, the number of levels of gray-scale of which display can be available, is remarkably increased compared with the number of sub fields in a field. Thus, plural patterns are provided as sub field drive patterns corresponding to a similar or equivalent brightness, and the degree of freedom of pattern setting is enhanced.

In addition, the first and the second pixel driving devices set the period of sub field to be shorter than non-transmissive response time when transmittance ratio of the electro optic material is transferred from a saturated state, to a non-transmissive state in response to the applied off-voltage.

According to such a structure, the non-transmissive response time of an electro-optical material is longer than time of a one sub field, so that the light transmittance ratio of electro-optical material can be varied more finely than the number of sub fields in one field. Hence, the number of levels of gray-scale of which display is available is increased remarkably in comparison with the number of sub fields in one field, so that the degree of freedom of pattern setting can be improved.

In addition, the first and the second pixel driving devices apply the on-voltage to the electro-optical material during continuous or discontinuous sub fields, so that an integral value of a transmissive state of the electro-optical material in the field period is saturated in response to display data.

According to such structure, the on-voltage is applied to the electro-optical material during continuous or discontinuous sub fields, so that an integral value of a transmissive state the electro-optical material corresponds to display data. Hence, display with multi numbers of levels of gray-scale is available.

In addition, the first and the second pixel driving devices apply the on-voltage to the electro optic material during the period of a sub field at the former end part of the field period intensively.

According to such structure, a response characteristic of a display can be improved since it is easy for electro-optical material be in a non-transmissive state at the end part of the field period.

In addition, the first and the second pixel drive devices apply the off-voltage to the electro-optical material in the sub field period of the latter end of the field period intensively.

According to such a structure, response characteristic of a display can be improved since it is easy for electro-optical material be in a non-transmissive state at the end part of the field period.

In addition, a plurality of sub fields within each field is set to have a almost equivalent time width.

Such structure can be applied easily to the sub field drive of liquid crystal devices.

In addition, sub fields within each field are set to have plural different time widths.

Such structure can be applied to weighting sub field drive of plasma displays.

A method of driving an electro-optical device of the present invention includes a display portion having pixel arranged in a matrix with electro-optical material of which a light transmittance ratio is changed by applying voltage, supplies on-voltage to make the light transmissive ratio be saturated, or off-voltage to make the light transmittance ratio be a non-transmissive state to the display portion, implements sub field drive to realize gray-scale display in response to the ratio of an optical transmissive state to a non-transmissive state of the electro-optical material per unit time and time ratio; and includes: a process of driving the pixel with each sub field as a unit of control that is formed by dividing a field into plural portions on a time axis; and a process of driving pixels, located adjacently each other, in a control area that is composed of the predetermined number of pixels, by sub field driving with changing the arranged pattern of the sub field of applying the off-voltage and the sub field of applying the on-voltage to liquid crystal.

According to such structure, the light transmittance ratio of the electro-optical material composing each pixel is variable by applying voltage. In the sub field drive, each of sub fields that are formed by dividing a field into plural portions on a time axis is a unit of control. Each pixel is driven by applying on-voltage for making the light transmittance ratio be saturated, or off-voltage to make it be a non-transmissive state to electro optic material. A gray-scale display is reproduced by determining a sub field of applying the on-voltage and a sub field of applying the off-voltage based on displaying data. On this determination, in pixel drive processing, adjacent pixels, as a control area unit including predetermined number of pixels, are driven by sub field drive with changing a pattern of sub field of applying the on-voltage and a sub field of applying the off-voltage to liquid crystal. Hence, adjacent pixels are driven by different sub field drive patterns, so that flickering of adjacent pixels due to sub field drive is not remarkable and flickering can be reduced.

A method of driving an electro-optical device of the present invention includes a display portion having pixels arranged in a matrix with electro-optical material of which an light transmittance ratio is changed by applying voltage, supplies on-voltage to make the light transmittance ratio be saturated, or off-voltage to make the light transmittance ratio be in a non-transmissive state to the display portion, implements sub field drive to realize gray-scale display, in response to the ratio of an optical transmissive state to a non-transmissive state of the electro-optical material per unit time and time ratio; and includes: a first process of driving the pixel with each sub field as a unit of control that is formed by dividing a field into plural portions on a time axis and driving the pixel located at a predetermined position in an image by a first sub field drive pattern that is an arranged pattern of a sub field of applying the off-voltage and a sub field of applying the on-voltage; and a second process of driving the pixel with a sub field as a unit of control, that is formed by dividing a field into plural portions on a time axis and driving a pixel adjacent to the pixel located at a predetermined position in an image by at least one second sub field drive pattern differentiated from the first sub field drive pattern.

According to such structure, when gray-scale is displayed, a predetermined pixel is driven by the first the sub field drive pattern in the first pixel drive processing and pixel adjacent to the predetermined pixel is driven by the second sub field drive pattern in the second pixel drive processing. Thus, adjacent pixels are driven by different sub field drive patterns so that blinking of adjacent pixels due to sub field drive is not remarkable and flickering can be reduced.

An electro-optical device related to the present invention is provided with the abovementioned drive circuit of the electro-optical device.

Hence, adjacent pixels are driven by different sub field drive pattern so that blinking of adjacent pixels, due to sub field drive, is not remarkable and it is possible to realize display with reduced flickering.

An electronic apparatus related to the present invention is provided with the above-mentioned electro-optical device.

According to such structure, it is possible to realize display with reduced flicking.

BRIEF DESCRIPTION OF THE DRAWINGS

FIG. 9 is a schematic that shows another example of a predetermined sub field drive pattern stored in the code storing ROM 31.

FIG. 10 is a schematic that explains setting of start timing of a drive system field when a control area is four pixels of two-by-two.

FIG. 13 is a schematic that shows sub field drive pattern when it is applied to weighting sub field drive.

FIG. 14 is a plane view that shows constitution of the electro-optical device 100.

DETAILED DESCRIPTION OF PREFERRED EMBODIMENTS

Figure 1:
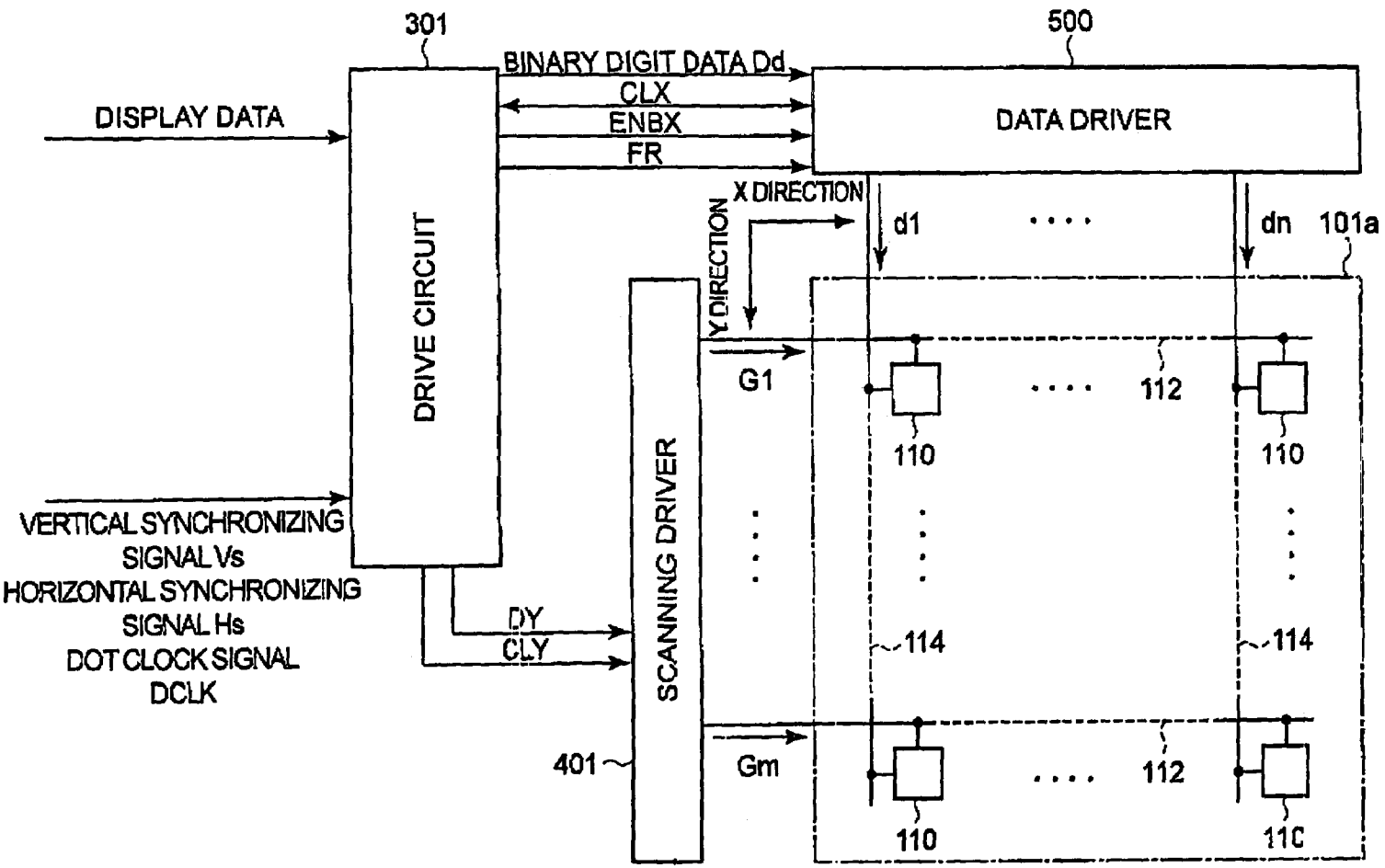
FIG. 1 is a block schematic that shows an electro-optical device related to the first exemplary embodiment of the present invention.

An exemplary embodiment of the present invention is explained in detail with reference to drawings. FIG. 1 is a black schematic showing an electro-optical device related to the first exemplary embodiment of the present invention.

An electro-optical device related to the present exemplary embodiment is a liquid crystal device, in which liquid crystal is used as electro-optical material. For example, it includes a structure where an element substrate and an opposite substrate are affixed together, keeping a specific spacing as described hereinafter. Liquid crystal, as electro-optical material, is sandwiched within this spacing. Here, a display mode of the electro-optical device is normally black, namely a white image is displayed when voltage is applied to a pixel (on-state) and a black image is displayed when voltage is not applied (off-state).

According to the present exemplary embodiment, a sub field drive method is adopted as a method of driving a liquid crystal, where one field is divided into plural sub fields on a time axis, this sub field is defined as a control unit and liquid crystal is driven every sub field period.

In case of obtaining medium brightness by analog drive, liquid crystal is driven with voltage which is less than or equal to a drive voltage for transmittance ratio to be saturated (it is referred to as liquid crystal saturation-voltage thereafter). Therefore, the light transmittance ratio of liquid crystal is generally proportional to drive voltage and an image display, of which brightness is in response to driving voltage, is obtained.

However, in sub field drive, drive voltage, which is equal to or more than liquid crystal saturation-voltage (it is referred to as on-state voltage thereafter) is applied to liquid crystal and the light transmittance ratio of liquid crystal is saturated. Then, it can obtain an image of whose brightness is proportional to ratio of time of applying on-voltage to time of applying voltage (it is referred to as off-state voltage thereafter). Specifically, roughly proportional to time of applying drive voltage per relatively short-unit time (one field period for example).

Specifically, pulse signal having a pulse width corresponding to one sub field period Ts (written data for a pixel) is used as driving signal to drive liquid crystal. In addition, a pulse signal is a signal having binary digit to one or zero. For example, if one field is equally divided into 255 sub fields and the brightness to be displayed is brightness of N divided by 256 levels of gray=scale, pulse signal is controlled to be output during time for N sub fields (Tx×N) and voltage is not applied during the rest (255-N) of sub fields within one field. Thus, brightness of N divided by 256 levels of gray-scale can be obtained.

In this case, various kinds of drive patterns (it is referred to as sub field drive patterns hereafter) of sub field of applying on-voltage to liquid crystal of each pixel and sub field of applying off-voltage (voltage for liquid crystal is non-transmissive) are considered. For example, a pattern (it is referred to as a pattern of placing emphasis on responsiveness hereafter) of applying on-voltage continuously during sub field periods, of which numbers are corresponding to brightness from start of a field is considered.

The light transmittance ratio of liquid crystal is changed by applying drive voltage and transferring its orientation state. In this case, liquid crystal has a characteristic in that its response speed between a non-transmissive state and a saturated state of the light transmittance ratio becomes faster in response to the size of electric field that is applied to a liquid crystal layer under a given temperature T.

Therefore, when a non-transmissive state is transferred to a saturated state of the light transmittance ratio by applying an electric field to liquid crystal, high voltage should be applied at as earliest timing as possible. However, when a saturated state of the light transmittance ratio is transferred to a non-transmissive state, the electric field should be removed from the liquid crystal layer at as easily a timing as possible. Hence, response speed can be higher thereby, so that sight recognition for a moving image can be improved.

Specifically, if a pattern of placing emphasis on responsiveness, where on-voltage is applied at the former half part of a field and not applied at the latter half part of a field, is adopted, a liquid crystal layer is controlled to be a non-transmissive state at the latter end of a field as much as it can, so that a favorite response sight recognition can be obtained.

Further, sub field drive is also adapted to a plasma display. In a plasma display, writing time into pixels (scanning time) is necessary every sub field period. If a sub field period is narrowed, and the number of sub fields within one field is increased, the number of times to write image data to pixels within one field is increased, so that a displayed image becomes darkened due to short luminescence-time because of this writing. Thus, in a plasma display, overall length of sub field periods within one field (time width) is changed so that time weighting sub field drive where each sub field is weighted is implemented.

However, in a liquid crystal device, it is possible that luminescence-time is not shortened even if the number of sub fields in one field are increased. In addition, the larger the number of sub fields within one field, the large the number of levels of gray-scale of which display can be available. Therefore, when gray-scale reproduction is considered in a liquid crystal device, it is preferable that the numbers of sub fields are increased within one field. However, such numbers of sub fields within one field are restrained by device constraint on speedup.

Hence, saturation-response time of liquid crystal (time to obtain the maximum light transmittance ratio from the time of applying saturation-voltage of liquid crystal) is 2 to 5 milliseconds if it is used for a projector, for example. This is longer than the time width of a sub field period that can be realized in a constrained device. Thus, the number of levels of gray-scale of which display can be available is increased without increasing numbers of sub fields within one field.

Next, control of gray-scale display regarding the present exemplary embodiment is explained referring to FIG. 3. FIG. 3 shows change of the optical response of liquid crystal (the light transmittance ratio) of each sub field period within one field, where the horizontal axis is time and the vertical axis is the light transmittance ratio. An area with oblique lines in FIG. 3 shows a sub field period of applying on-voltage to liquid crystal of each pixel and a plain area without oblique lines shows the sub field period of applying off-voltage.

In case of using electro-optical material having a fast response characteristic such as a plasma display, brightness of the pixel is determined by the time ratio of a sub field period of applying on-voltage (driving voltage for illumination) to electro-optical material to a sub field period of applying off-voltage (driving voltage for non illumination). The former sub field period is referred to as sub field period for on-state and the latter sub field period is referred to as sub field period for off-state. However, when saturation-response time is longer than the time width of sub field period such as liquid crystal, brightness of a pixel is actually proportional to integral value of the transmittance ratio.

FIG. 3 shows an example where one field is divided into six sub fields SF1 . . . Sf6, on a time axis. Specifically, FIG. 3 is an example when a pixel is driven every sub field period obtained by dividing one field into six equal parts.

Grey-scale is displayed by applying voltage to each pixel to make each pixel be in an on state (the state of saturating transmittance ratio) or be in an off state (the state of the light transmittance ratio is 0) in each of the sub field periods from Sf1 to Sf6, based on data for displaying brightness (it is referred to as gray-scale data hereafter).

Applied voltage (drive voltage) to the pixel is saturated instantaneously. But, the response of the transmittance ratio of liquid crystal is slow and such transmittance ratio of liquid crystal is saturated after the given delay time, as shown in FIG. 3. FIG. 3 shows an example of using liquid crystal material that needs time of three to four sub fields in order be optically saturated when the on-voltage is applied to this liquid crystal. Further, the liquid crystal material also needs longer time than one sub field even for the non-transmissive response time that the light transmittance ratio is transferred from a saturated state to a non-transmissive state at the time of applying off-voltage.

Namely, in an example of FIG. 3, the light transmittance ratio of liquid crystal is changed to 4/10 of the saturated light transmittance ratio during the first sub field period after applying on-voltage. Next, it is changed to 7/10 within a next sub field period, namely during two sub field periods after applying on-voltage. Then, it is changed to 8/10 during three sub field periods after applying on-voltage. Further, it is changed to 10/10 during four sub field periods after applying on-voltage.

On the other hand, in the example of FIG. 3, the light transmittance ratio of liquid crystal is decreased by 3/10 of the saturated light transmittance ratio during the first sub field period after applying off-voltage. Next, it is decreased by 5/10 during two sub field periods after applying off-voltage. Then, it is decreased by 7/10 during three sub field periods after applying on-voltage. Further, it is decreased by 9/10 during four sub field periods after applying on-voltage.

FIG. 3(*a*) shows an example of applying on-voltage during three sub field periods in the former part of a field period and applying off-voltage during three sub field periods in the latter part of a field period. The transmittance ratio of liquid crystal rises up to 4/10 of the saturated light transmittance ratio during the first sub field period, rises up to 7/10 of the saturated light transmittance ratio during the second sub field period and rises up to 8/10 of the saturated light transmittance ratio during the third sub field period. Furthermore, the light transmittance ratio drops to 5/10 of the saturated light transmittance ratio during the fourth sub field period, drops to 3/10 during the fifth sub field period and drops to 1/10 of i during the sixth sub field period.

As above mentioned, brightness varies in proportion to the integral value of the light transmittance ratio when the cycle of sub field drive (one field period in an example of FIG. 3) is short enough. If a whole white image is displayed with the 100% transmittance ratio during all sub field periods, brightness during a field period in FIG. 3(*a*) is $\{(4+7+8+5+3+1)/10\}\times 1/6=28/60$ of perfect white display.

Similarly, in an example of FIG. 3(*b*), brightness is $\{(4+3+1)/10\}\times 1/6=8/60$ of perfect white display. In addition, in an example of FIG. 3(*c*), brightness is $\{(4+3+1+4+3+1)/10\}\times 1/6=16/60$ of perfect white display. In addition, in an example of FIG. 3(*d*), brightness is $\{(4+7+4+3+2+1)/10\}\times 1/6=21/60$ of perfect white display.

When sub field periods of applying on-voltage are simply continued, only the level of six plus one equals seven of gray-scale is obtained during six divided sub field periods formed by dividing a field to six parts. However, in the case of FIG. 3, it is possible to display numbers of levels of gray-scale which are remarkably larger than seven levels of gray-scale by adopting sub field drive pattern (it is referred to as pattern for placing emphasis on gray-scale reproducibility.) where a position of sub field period of applying on-voltage and a position of sub field period of applying off-voltage are arranged appropriately.

For example, if one field is divided into sixteen sub fields on a time axis, only seventeen levels of gray-scale are obtained by these sixteen sub fields when sub field periods of applying on-voltage are simply continued. However, it an arrangement of sub fields of applying on-voltage and sub fields of applying off-voltage is considered, more than one hundred sixty or more levels of gray-scale can be available. Similarly, if one field is divided into thirty-two sub fields on a time axis, two hundred fifty-six or more levels of gray-scale can be available.

Thus, human eyes feel brightness according to the integral value of the light transmittance ratio per unit time. Therefore, according to the exemplary embodiment, even if adjacent pixels have similar pixel values, it is possible to differentiate timing of flickering with sub field drive by controlling timing of start of a unit time, which is independent from a display data field (it is referred to as a reference field). Hence, flickering can be reduced thereby.

In FIG. 1, an electro-optical device in the exemplary embodiment includes a display region 101 a using liquid crystal as electro-optical material, a scanning driver 401 driving each pixel in this display region 101*a*, a data driver 500 and a drive circuit 301 supplying various kinds of signals to the scanning driver 401 and the data driver 500.

In an electro-optical device related to the exemplary embodiment, a transmissive substrate, such as a glass substrate, is used as an element substrate. Transistors driving pixels and peripheral drive circuits are formed on the element substrate. In a display region 101*a* on the element substrate, plural scanning lines 112 are formed extending to the X (row) direction and plural data lines 114 are formed extending to the Y (column) direction. A pixel 110 is installed at each intersection of the scanning line 112 with the data line 114. These plural lines are arranged in a matrix.

The present exemplary embodiment is described for convenience of explanation on the premise that the total number of the scanning lines 112 is m and the total numbers of the data lines 114 is n (m, n are two or more integers respectively), illustrating a m rows×n columns matrix type display device. However, the invention is not limited such definition.

Figure 4:
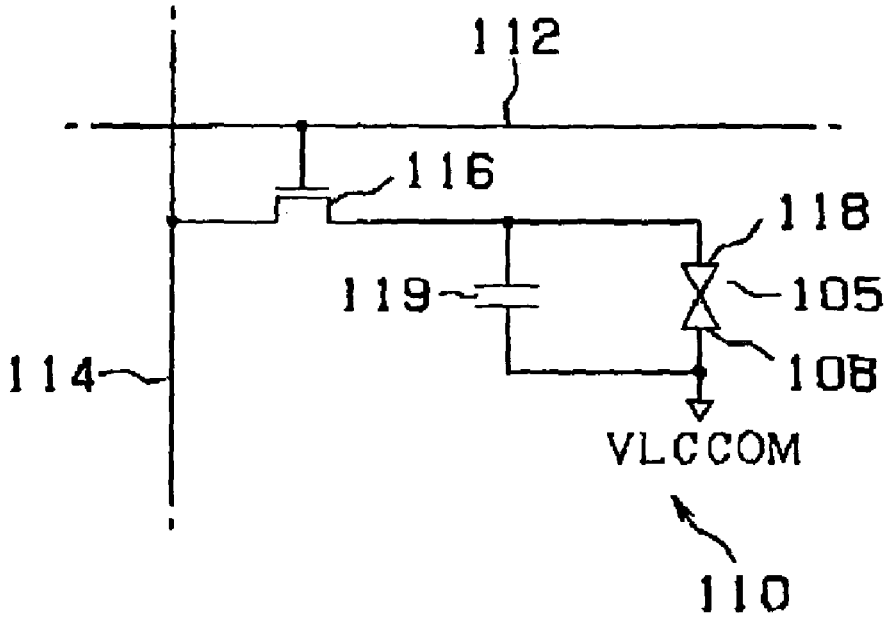
FIG. 4 is a schematic that shows concrete constitution of the pixel in FIG. 1.

FIG. 4 is a schematic showing a concrete structure of a pixel in FIG. 1.

Each pixel 110 includes a transistor (pSi TFT) 116 as a switching device. The gate of the transistor 116 is connected to the scanning line 112, the source is connected to the data line 114 and the drain is connected to a pixel electrode 118. Liquid crystal 105 as an electro-optical material is sandwiched between the pixel electrode 118 and the opposite electrode 108, so as to form a liquid crystal layer. The opposite electrode 108 is a transmissive electrode that is formed on an overall surface of the opposite substrate and located opposite to the pixel electrode 118.

An opposite electrode voltage VLCCOM is applied to the opposite electrode 108. In addition, a storage capacitance 119 is formed between the pixel electrode 118 and the opposite electrode 108, and it accumulates electric charge along with the electrodes sandwiching the liquid crystal layer. Further, in the example of FIG. 4, the storage capacitance 119 is formed between the pixel electrode 118 and the opposite electrode 108. But it may be formed between the pixel electrode 118 and the ground potential GND or the pixel electrode 118 and the gate line. Further, it may also be formed between wirings which have the same potential as the opposite electrode voltage VLCCOM on the element substrate.

Each of the scanning signals G1, G2, . . . Gm is supplied to each of the scanning lines 112 from the scanning driver 401 described hereafter. All transistors 116 constituting pixels on each line are an on-state simultaneously by each scanning signal and an image signal supplied from the data driver 500 described hereafter, to each of the data lines 114 is written into the pixel electrode 118. An oriented state of molecule groups of liquid crystal 105 varies in response to a potential difference between the pixel electrode 118 where are image signal is written and the opposite electrode 108, so that light is modulated, and gray-scale display can be available.

As described above, according to the exemplary embodiment, one field is divided into plural sub fields on a time axis and writing pixel data into each of pixels 110 is controlled every sub field period.

Figure 2:
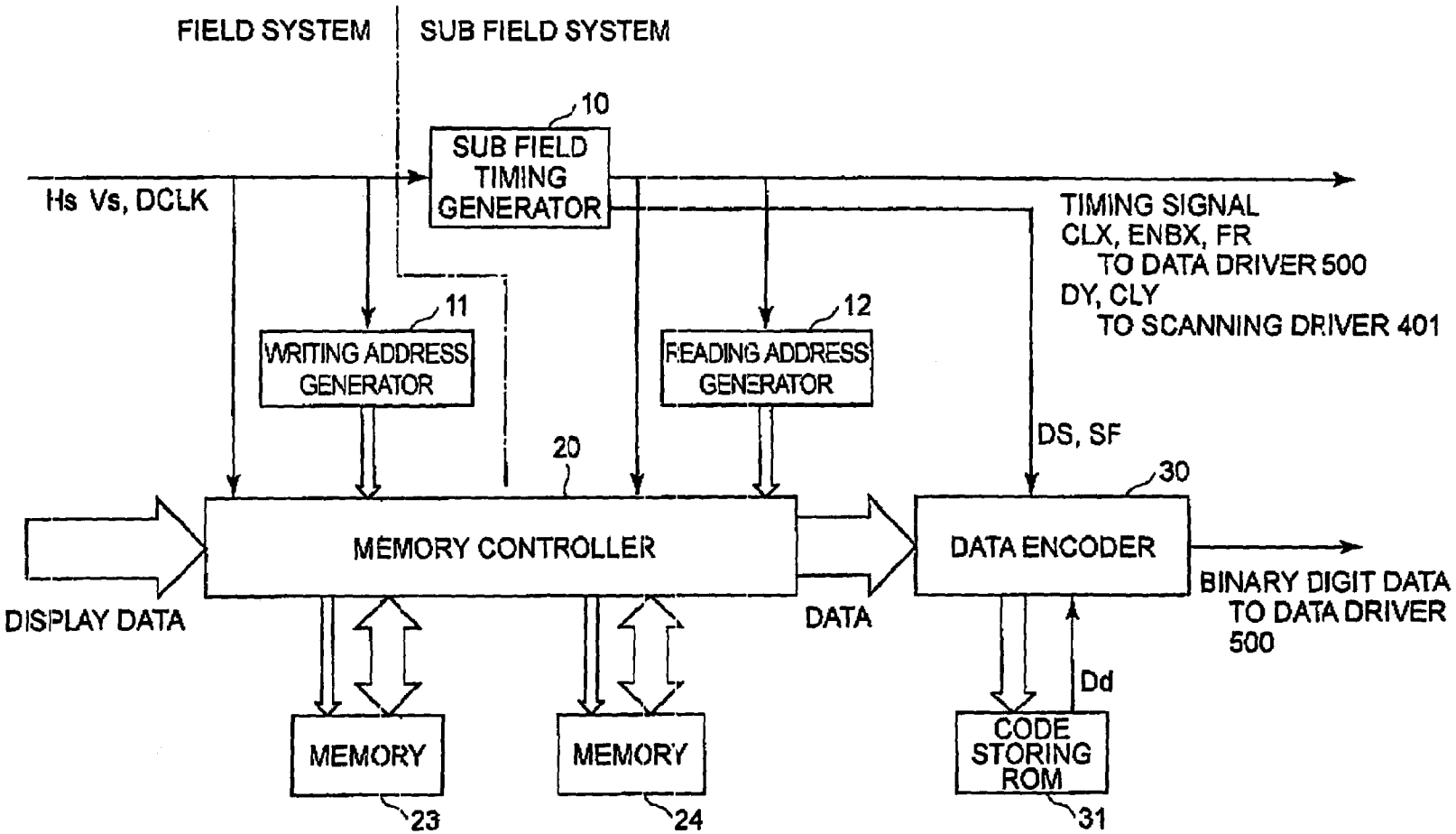
FIG. 2 is a block schematic that shows concrete constitution of the drive circuit 301 in FIG. 1.
Figure 3A:
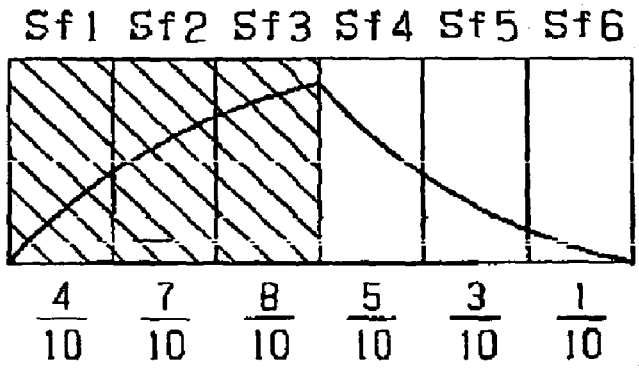
FIG. 3 is a graph to explain control of gray-scale display in an exemplary embodiment.
Figure 3B:
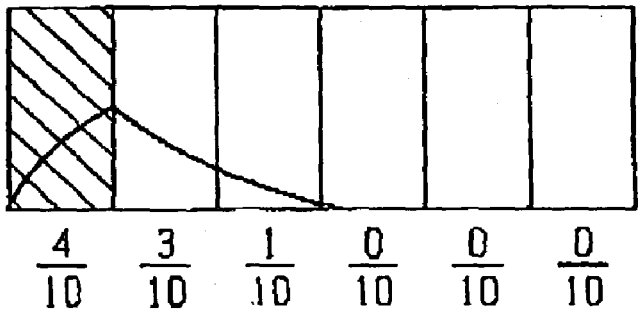
Figure 3C:
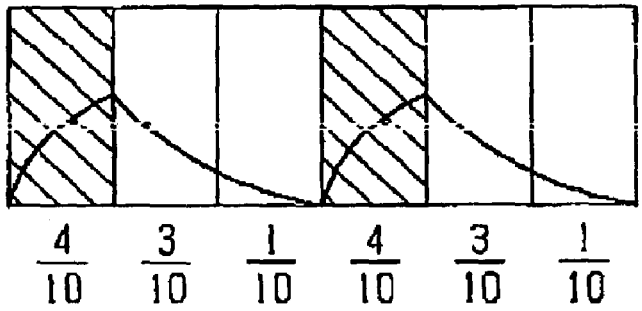
Figure 3D:
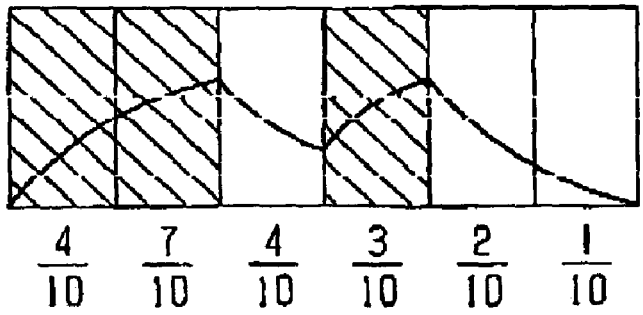

Next, a structure of a drive system to drive a display region is explained. FIG. 2 is a block schematic showing a concrete structure of the drive circuit 301 in FIG. 1.

In FIG. 2, a vertical synchronizing signal Vs, supplied from the outside, a horizontal synchronizing signal Hs and a dot clock DCLK are inputted into the sub field timing generator 10. The sub field timing generator 10 produces a timing signal used in the sub field system on the basis of the inputted horizontal synchronizing signal Hs, the vertical synchronizing signal Vs and the dot clock DCLK.

Namely, the sub field timing generator 10 produces a data transfer clock CLX, a data enable signal ENBX, a polarity turning over signal FR, which are signals to drive a display, and outputs them to the data driver 500. Further, the sub field timing generator 10 produces a scanning start pulse DY, and a canning side transfer clock CLY, and outputs them to a scanning driver 401. Further, the sub field timing generator 10 produces a data transfer start pulse DS, and a sub field identification signal SF, which are used inside of a controller, and outputs them to a data encoder 30.

The polarity turning over signal FR is a signal of which polarity turns over every 1 field. The scanning start pulse DY is a pulse signal outputted at a start point of each sub field and the scanning driver 401 outputs gate pulses (G1 . . . Gm) sequentially by inputting the scanning start pulse DY into the scanning driver 401.

As described above, one field is divided into plural sub fields SF1 . . . Sfs on a time axis and binary digits voltage is applied to the liquid crystal layer in response to gray-scale data every sub field period. The start pulse DY is a signal showing switch of each of the sub fields, and write scanning to a display area is implemented every output of this pulse.

The scanning side transfer clock CLY is a signal that regulates scanning speed of the scanning side (Y side). Gate pulses (G1 . . . Gm) synchronize with this transfer flock and are transferred every scanning line.

The data enable signal ENBX determines timing of outputting data stored in a X bit shift register 510, described below, in the data driver 500 in parallel with several pixels in a horizontal direction. The data transfer clock CLX is a clock signal to transfer data to the data driver 500. The data transfer start pulse DS regulates timing of starting data transfer from the data encoder 30 to the data driver 500 and this pulse is sent to the data scanning encoder 30 from the sub field timing generator 10. The sub field identification signal SF informs the date encoder 30 of what the number pulse (sub field) is.

The drive voltage generation circuit, which is not illustrated in the figure, generates voltage V2, producing the scanning signal and gives it to the scanning driver 401, generates voltages V1, –V1, V0, producing the data line drive signal, and gives them to the data driver 500. Further, it generates opposite electrode voltage VLCCOM and gives it to the opposite electrode 108.

Voltage V1 is a data line drive signal that is outputted to the liquid crystal layer as a high level positive signal referring to voltage V0, when alternative current drive signal FR is at a high level (it is referred to as H level). Voltage V1 is a data line drive signal that is outputted to the liquid crystal layer as a high level negative signal referring to voltage V0, when alternative current drive signal FR is low level (it is referred to as L level).

However, inputted display data is supplied to a memory controller 20. A writing address generator 11 specifies a position of data on an image, which is sent at that time, by the horizontal synchronizing signal Hs, the vertical synchronizing signal Vs, and the dot clock DCLK that are inputted by the outside. Based on this specified result, it produces a memory address to store display data in memories 23,24 and outputs it to the memory controller 20.

A reading address generator 12 specifies a position of data on an image, which is displayed at that time, by a timing signal of sub field system produced by the sub field timing generator 10. Based on this specified result, it produces a memory address to read data in memories 23,24 based on the same rule as writing and outputs them to the memory controller 20. Further, the reading address generator 12 outputs position data of each pixel on an image, which are obtained here, to the data encoder 30.

The memory controller 20 writes inputted display data to the memories 23,24 and controls reading such written data from memories 23,24. Namely, the memory controller 20 writes data inputted from the outside to the memories 23, 24, synchronously with the timing signal DCLK in response to an address produced in the writing address generator 11. Further, reading is implemented synchronously with a timing signal CLX produced by the sub field timing generator 10 in response to an address produced in the reading address generator 12. The memory controller 20 outputs read data to the data encoder 30.

In the sub field drive, data is written to a pixel every sub field. Therefore, it is necessary to produce the binary digits data that determine on and off of a sub field based on display data, which is held in a field memory and then read from the field memory every sub field.

The memories 23,24 are installed for this reason. One of the memories 23,24 is used to write inputted data and another is used to read data. Such roles of the memories 23,24, are switched by the memory controller 20 sequentially every field.

The data encoder 30 produces an address in order to read necessary data from the code storing ROM 31 by data, sent from the memory controller 20, the sub field identification signal SF, sent from the sub field timing generator 10, and position data of a pixel, sent from the reading address generator 12. Then, by using this address, it reads data from the code storing ROM 31 and outputs them to the data driver 500 synchronously with a data transfer start pulse DS.

The code storing ROM 31 stores a group including binary digit signals Dd of H level or L level for making a pixel be an on-state or off-state every sub field, toward gray-scale data displayed in a pixel (a code specifying whether each of sub fields within one field is on or off). When the code storing ROM 31 inputs gray-scale data of each pixel and sub field for writing as an address, it outputs one bit data (the binary digit signal (data) Dd) in response to its sub field.

According to the exemplary embodiment, the data encoder 30 changes a sub field drive pattern in order to differentiate timing of flickering every unit of a predetermined display area regarding adjacent pixels. For example, the data encoder 30 changes a sub field driver pattern every pixel shifting sub field drive patterns by the predetermined number of sub field periods.

For example, the data encoder 30 sets two pixels as display area (it is referred to as a control area) to control timing of flickering and shifts a sub field drive pattern outputted every adjacent pixel by ½ field. Namely, regarding each of the adjacent pixels, timing of starting a field to write pixel data (it is referred to as drive system field) is shifted by a ½ field period.

Figure 7:
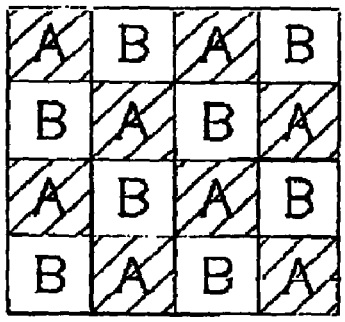
FIG. 7 is a schematic that explains setting of start timing of a drive system field when a control area is two pixels.
Figures 8A, 8B:
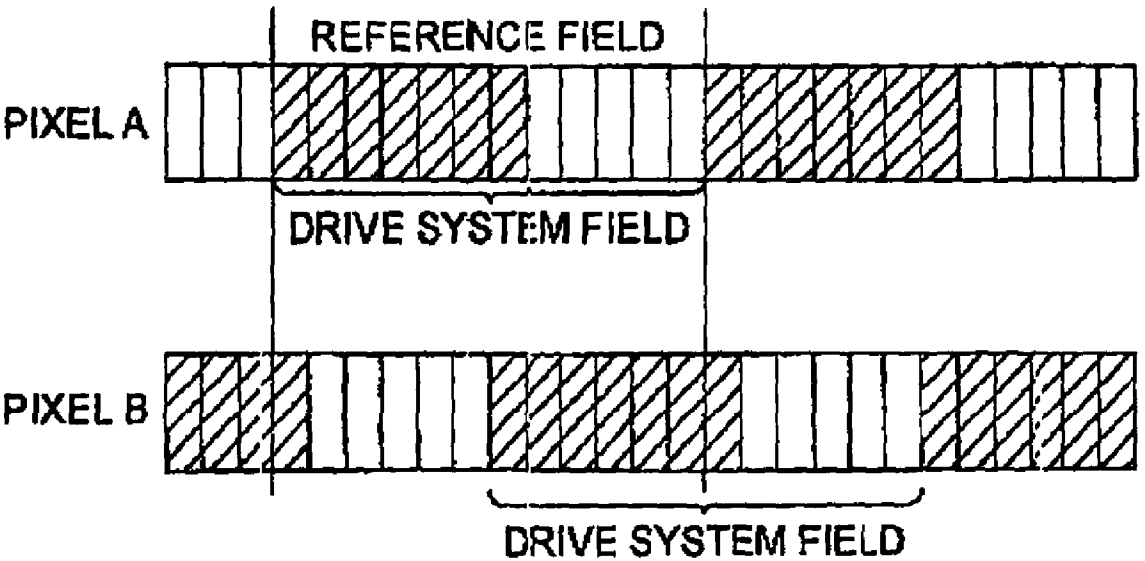
FIG. 8 is a schematic that explains setting of start timing of a drive system field when a control area is two pixels.

It is necessary that the data encoder 30 recognizes a pixel position of each pixel in order to determine start timing of a drive system field of each pixel. FIG. 7 and FIG. 8 are schematics to explain setting of start timing of a drive system field when a control area is two pixels.

FIG. 7 shows a predetermined display area of 4×4 pixels by a frame. A and B in FIG. 7 are referred to with the same symbols which have the same timing of starting drive system field. Specifically, in an example of FIG. 7, timing of starting a drive system field is shifted every one pixel as two pixels as a group (control area) and the amount of shift is a ½ field period, for example.

FIG. 8 shows an example of the predetermined sub field drive pattern stored in the code storing ROM 31. In the example of FIG. 8, one field is divided into twelve sub fields on a time axis to drive a pixel every each sub field unit.

FIG. 8 shows an example of a pattern to place emphasis on responsiveness, where continuous seven sub fields from the former end of reference sub fields within twelve sub fields are on. When timing of starting a drive field as one pixel unit is shifted by ½ field period, the data encoder 30 determines the amount of shift (whether to shift or not) for an object pixel, to which binary digits data is outputted, based on position data from the reading address generator 12. For example, when the pixel A in FIG. 7 is driven by using a pattern to place emphasis on responsiveness shown in FIG. 8(*a*), the amount of shift regarding the pixel A is 0 and the amount of shift regarding the pixel B is a half of a field, namely, a period of six sub fields in this case.

The data encoder 30 demands an address to read data from the code storing ROM 31 based on the new SF signal that is obtained by adding the inputted SF signal to the numbers (six in the example of FIG. 8) of sub fields, which are equal to a ½ fields. Here, when the value obtained by adding the amount of shift is over the number of sub fields, the value of SF is advantaged as follow;

Namely, it is assumed that one field =twelve sub fields and sub fields are counted as one to twelve here. If the amount of shift is ½ field, for example, in case of SF=four, it is assumed that SF=ten at the position of a pixel which should be shifted, and in case of SF=eight, SF=two at the position of a pixel which should be shifted.

In this way, a sub field drive pattern regarding the pixel B in FIG. 7 is shown in FIG. 8(*b*). Thus, timing of starting a drive system field can be easily shifted every pixel without changing other timing signals in drive system by controlling to read from the code storing ROM 31.

In addition, FIG. 9 shows another example of a predetermined sub field drive pattern stored in the code storing ROM 31. FIG. 9 shows an example of a pattern to place emphasis on gray-scale reproducibility, which make a sub field located at an appropriate position in a reference field be on.

In the example of FIG. 9, the sub field pattern of FIG. 9(*a*) is designated for the pixel A in FIG. 7. And the sub field drive pattern of FIG. 9(*b*) is designated for the pixel B.

Comparing the example of FIG. 9 with that of FIG. 8, timing of the sub field being on is different between the pixel A and the pixel B. Specifically, timing of flickering is different between adjacent pixels so that flickering can be reduced.

Figures 11A, 11B, 11C, 11D:
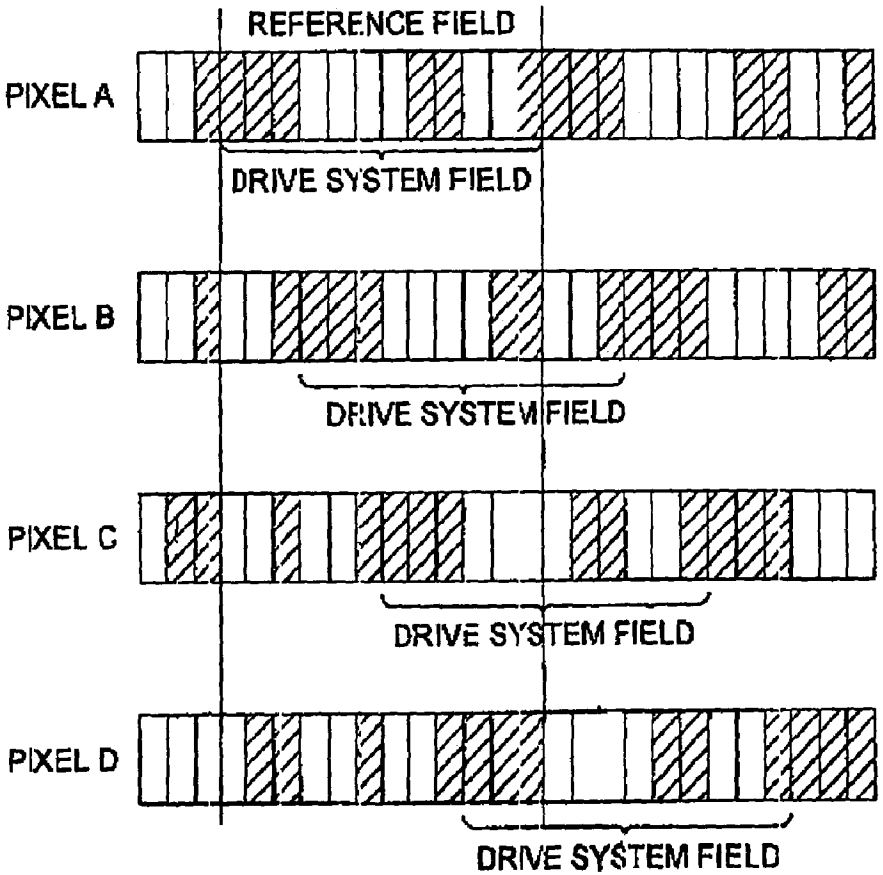
FIG. 11 is a schematic that explains setting of start timing of a drive system field when a control area is four pixels of two-by-two.

The data encoder 30 can set the appropriate number of pixels as a control area to shift start timing of a drive system field. For example, the data encoder 30 can make a control area be four pixels of 2×2 and the amount of shift among adjacent pixel be a period of ¼ field. FIG. 10 and FIG. 11 show a schematic of explaining control of this case.

FIG. 10 shows a predetermined display area of 4×4 pixels with a frame. A, B, C and D is FIG. 10 indicates pixels of which timing of starting each of drive system field is the same using the same symbols respectively.

Specifically, in an example of FIG. 10, four pixels located up, down, right and left have starting timing different among them. The amount of shift is a ¼ field period, for example.

FIG. 11 shows an example of a predetermined sub field drive pattern stored in the code storing ROM 31. The example of FIG. 11 is an example where one field is equally divided into twelve sub fields on a time axis, and start timing of a drive system field of each pixel is shifted by ¼ field mutually, namely, three sub fields.

In the examples of FIG. 10 and FIG. 11, timing of a starting drive system field can be shifted with a unit of four pixels by controlling reading of pixel data from the storing ROM 31, adding the amount of shift to the SF signal regarding pixels located at the position of shifting.

Thus, in this exemplary embodiment, the control area can be set to have an appropriate size. However, it is necessary to consider an arrangement of a sub field of each control area so that scanning of a predetermined control area is not overlapped with scanning of other control area during such write scanning. Hence, it is preferable, for example, that a position of each sub field for all pixels on a drive system field is not deviated on a time axis. At this time, it is necessary that the amount of shift is to be an integral multiple of a sub field period. In examples of FIG. 10 and FIG. 11, the amount of shift is a ¼ field period. But, this shift may be a predetermined sub field period, for example, a two sub field periods.

In FIG. 1, the scanning driver 401 transfers scanning start pulse DY, supplied at start point of a sub field, in response to the scanning side transfer clock CLY and supplies it as scanning signals G1, G2, G3, . . . , Gm sequentially and exclusively to each of the scanning lines 112.

The data driver 500 latches n pieces of binary digits data corresponding to number of data lines. Then, it supplies n pieces of latched binary digits data as data signals d1, d2, d3, . . . , dn to the data lines 114.

Figure 5:
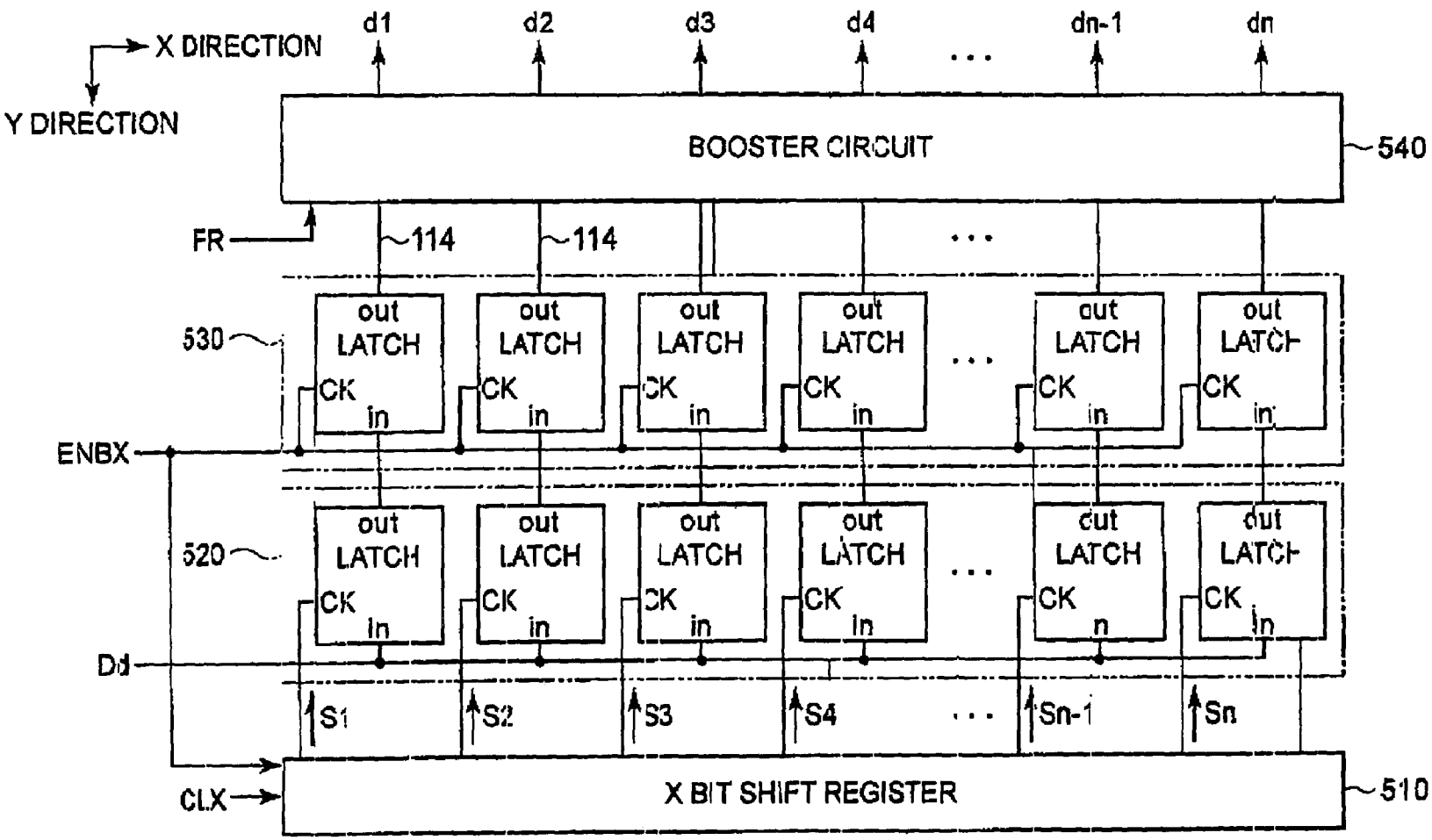
FIG. 5 is a block schematic that shows concrete constitution of the data driver 500 in FIG. 1.

FIG. 5 is a block schematic showing a concrete structure of the data driver 500 in FIG. 1. The data driver 500 includes a X bit shift register 510, a first latch circuit 520 for pixels in horizontal direction, a second latch circuit 530, a booster circuit 540 for pixels in horizontal direction.

The X bit shift register 510 transfers the data enable signal ENBX, supplied at a starting timing of a horizontal scanning period, corresponding to the clock signals CLX and supplies it sequentially and exclusively as latch signals S1, S2, S3, . . . , Sn to the first latch circuit 520. The first latch circuit 520 latches binary digits data sequentially at the time of falling of the latch signals S1, S2, S3, . . . , Sn. The second latch circuit 530 latches each of binary digits data all at once, latched by the first latch circuit 520, at the time of rising of the data enable signal ENBX and supplies them as data signal d1, d2, d3, . . . , dn to each of data lines 114, respectively, via the booster circuit 540.

Figure 6:
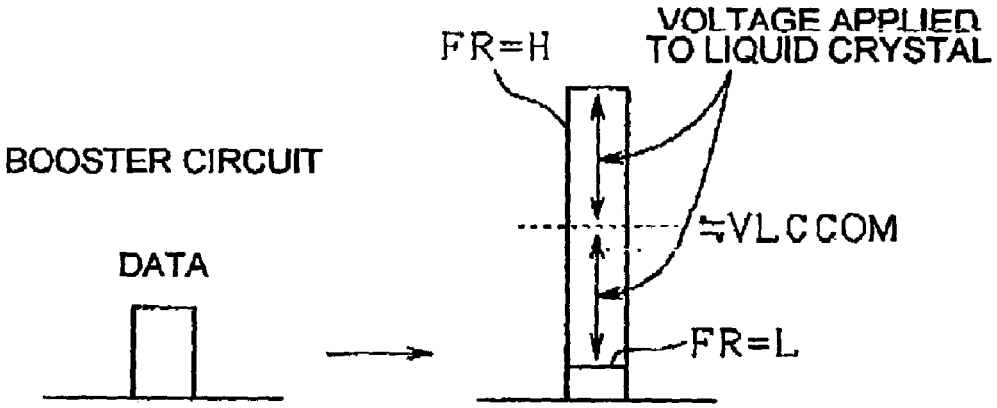
FIG. 6 is a schematic that explains operation of the booster circuit 540.

The booster circuit 540 is provided with polarity turning over function and booster function. The booster circuit 540 boosts voltage based on a polarity turning over signal FR. FIG. 6 shows operation of the booster circuit 540. For example, if the polarity turning over signal FR is H level, the booster circuit 540 outputs plus voltage of driving liquid crystal, when it inputs data signal making a pixel be an on-state. In addition, if the polarity turning over signal FR is L level, it outputs minus voltage of driving liquid crystal, when it inputs data signal making a pixel be an on-state. In case of data making a pixel be an off-state, it outputs VLCCOM potential regardless of a state of the polarity turning over signal FR.

Further, as above mentioned, in the data driver 500, the first latch circuit 520 latches binary digits signals with point at time in a certain horizontal scanning period. Then, the second latch circuit 530 supplies them all at once as data signals d1, d2, d3, . . . dn to each of the data lines 114 in the next horizontal scanning period thereafter. Hence, the data encoder 30 compares operation in the scanning driver 401 with the data driver 500 and outputs a binary digit signal Dd at the timing of one horizontal scanning period ahead.

Figure 12:
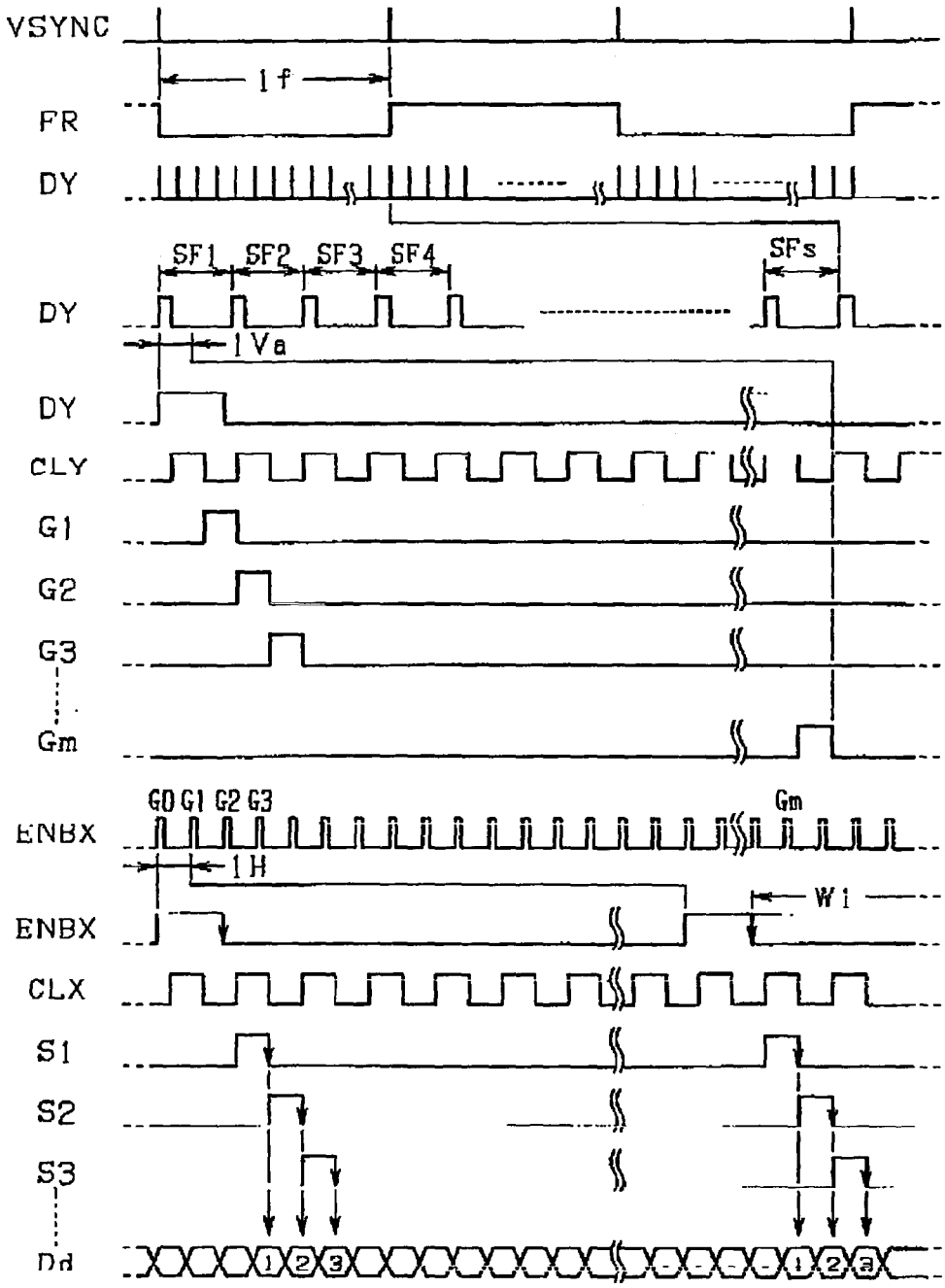
FIG. 12 is a timing chart that explains operation of an electro-optical device in the exemplary embodiment.

Next, an operation of this exemplary embodiment under this structure will be explained with reference to FIG. 12. FIG. 12 is a timing chart to explain an operation of an electro-optical device of this exemplary embodiment.

At first, drive of a pixel in a sub field is described. Alternative current signal Fr is the signal that turns level over every one field period (1*f*). Start pulse DY is generated at the start of each of sub fields Sf1 . . . Sfs. In a field period (1*f*) when alternative current signal FR is L level, start pulse DY is supplied so that scanning signals G1, G2, G3, . . . , Gm are outputted exclusively and sequentially by transfer corresponding to clock signal CLY in the scanning driver 401. Here, an example of FIG. 12 shows the case when one field is divided into s pieces of sub fields having the same time width on a time axis.

The scanning signals G1, G2, G3, . . . , Gm, have a pulse width corresponding to a half cycle of the scanning side transfer clock CLY. Further, after the start pulse DY is supplied, the scanning signal G1 corresponding to the first scanning line 112, counted from the top, is outputted, delay of at least a half cycle of the clock signal CLY after the clock signal CLY rises first. Therefore, one clock (G0) of data enable signal ENBX is supplied to the data driver 500 by the time when the scanning signal G1 is outputted after the start pulse DY is supplied.

Firstly, the case of supplying one clock (G0) of the data enable signal ENBX is explained. When the one clock (G0) of the data enable signal ENBX is supplied to the data driver 500, the latch signals S1, S2, S3, . . . , Sn are outputted exclusively and sequentially within a horizontal scanning period (1H) by transfer corresponding to the data transfer clock CLX. Here, the data signals S1, S2, S3, . . . , Sn have a pulse width corresponding to a half cycle of the data transfer clock CLX.

In this case, at the time of falling of the latch signal S1, the first latch circuit 520 in the FIG. 5 latches binary digits data for the pixel 110 corresponding to the intersection between the first scanning line 112 counted from the top and the first data line 114 connected from the left. Next, at the time of falling of the latch signal S2, it latches binary digits data for the pixel 110 corresponding to the intersection between the first scanning line 112 counted from the top and the second data line 114 countered from the left. Similarly, it latches binary digits data for the pixel 110 corresponding to the intersection between the first scanning line 112 counted from the top and the n-numbered data line 114 counted from the left sequentially.

Hence, at first, in FIG. 1, the binary digits data corresponding to pixels on a line, intersected with the first scanning line 112 counted from the top are latched with point at a time by the first latch circuit 520. Here, the data encoder 30 produces binary digits data corresponding to each sub field sequentially from display data of each pixel at the timing of latch by the first latch circuit 520 and outputs them.

Next, when the clock signal CLY falls and the scanning signal G1 is outputted, the first scanning line 112 counted from the top in FIG. 1 is selected. As a result, all transistors 116 of pixels 110 corresponding to a line intersected with the scanning line 112 are in an on-state.

However, at the time of falling the clock signal CLY, the data enable signal ENBX (G1) is outputted again. At the timing of rising of the signal ENBX, the second latch circuit 530 supplies binary digits data, latched with point at a time by the first latch circuit 520 to each of the corresponding data lines 114 as data signals d1, d2, d3, . . . , dn via the booster circuit 540. Hence, at the pixels on the first line counted from the top, data signals d1, d2, d3, . . . , dn are written simultaneously thereby.

In parallel with this writing, in FIG. 1, the binary digits data corresponding to pixels on a line, intersected with the second scanning line 112 counted from the top are latched with point at a time by the first latch circuit 520.

Similarly, the same operation is repeated until the scanning signal Gm corresponding to the m-numbered scanning line 112 is outputted. Here, the data signal written in the pixel 110 is held until the time of writing in the next sub field Sf2.

Next, binary digits data that are applied to pixels in each sub field are explained.

Here, in an display area shown in FIG. 7, for example, it is assumed that the sub field drive pattern varies every pixel. Further, it is assumed that a code of the sub field drive pattern shown in FIG. 8(*a*), for example, is stored as the sub field drive pattern corresponding to gray-scale data of a pixel A and B shown in FIG. 7, in the code storing ROM 31.

The memory controller 20 gives the inputted display data to memories 23, 24 in order and makes the memories 23, 24 to store display data of two fields. Namely, while the memory controller 20 reads display data before one field from one of the memories 23, 24, and outputs them to the data encoder 30, it writes current display data into the rest of another memory.

The data encoder 30 receives display data from the memory controller 20 and position data indicating of an object pixel on an image from the read address generator 12.

Here, it is assumed that the data encoder 30 inputs display data of the object pixel A and the position data indicating the position of the pixel A on an image. In this case, the data encoder 30 reads a code of the sub field drive pattern shown in FIG. 8(*a*) from the code storing ROM 31. Then, the data encoder 30 outputs binary digits data, based on the code read at each at each of sub field timing, to the data driver 500, in response to the SF signal from the sub field timing generator 10.

Here, it is assumed that the data encoder 30 inputs display data of the object pixel B and the position data indicating the position of the pixel B on an image. In this case, the data encoder 30 shifts the sub field drive pattern shown in FIG. 8(*a*) by a ½ field period and reads it from the code storing ROM 31.

Specifically, the data encoder 30 adds 6 to the SF signal from the sub field timing generator 10, reads binary digits data corresponding to each sub field from the code storing ROM 31 based on this added value and outputted it to the data driver 500.

For example, it is assumed that the data encoder 30 outputs binary digits data for writing pixel data with respect to the second sub field in the reference field. Regarding the pixel A, the data encoder 30 outputs the value designated in the second sub field of a drive system field of FIG. 8(*a*), namely "1". On the other hand, regarding the pixel B, the data encoder 30 outputs the value designated in the sub field of 2+6=8 of a drive system field in FIG. 8(*a*), namely "0". Thus, the data encoder 30 outputs a code of the sub field drive pattern shown in FIG. 8(*b*) regarding the pixel B.

Each pixel shows white display during the period of oblique lines portion and black display during the period of plain portion. As shown clearly from comparing FIGS. 8(*a*) with (*b*), it is frequent that the pixel B of FIG. 7 shows black display during the period when the pixel A of FIG. 7 shows white display. Namely, in this case, timing of monochrome blinking is different among adjacent pixels. Hence, flickering can be reduced thereby.

Here, even if the data encoder 30 uses a pattern to place emphasis on gray-scale reproducibility of FIG. 9, timing of monochrome blinking can be changed per unit pixel, as shown clearly by comparing FIG. 9(*a*) with (*b*). Further in this case, flickering can be further reduced since a cycle of blinking within a field is short.

Further, in an example of FIG. 11, timing of blinking can be changed among adjacent pixels and the same timing of blinking occurs by a unit of 2×2 pixels simultaneously.

similarly, the same operation can be repeated every time when the scanning start pulse DY regulating the start of sub field is supplied. Furthermore, when the alternative current signal FR is turned over to a H level after one field elapses, similar operation is repeated in each sub field.

Hence, when a code of a field drive pattern is shifted, brightness of each pixel is reproduced with a unit of cycle of plural fields.

Thus, according to an electro-optical device related to the exemplary embodiment, start timing of a drive system field of each pixel is controlled to be independent from the reference field, so that timing of blinking with a sub field drive is differentiated, even if pixel values of adjacent pixels are similar. Then, flickering can be reduced.

Here, in the above-mentioned exemplary embodiment, at the time of reading from the code storing ROM 31, start timing of a drive system field is changed every pixel by shifting outputted binary digits data on a time axis. On the other hand, it is preferable that a predetermined sub field drive pattern and a pattern that is obtained by shifting the predetermined number of sub field drive patterns are prepared beforehand and these two patterns are stored to the code storing ROM. Then, one of these patterns may be selected every pixel.

In addition, a pattern to place emphasis on gray-scale reproducibility can express the same gray-scale as plural patterns. Thus, it is preferable that another sub field drive pattern, of which pattern is different from the predetermined sub field drive pattern with the same or similar brightness given by it, is prepared beforehand instead of a pattern in which a sub field drive pattern is shifted by the predetermined number of sub fields. Then these patterns may be selected every pixel.

In addition, the present invention can be applied to the time weighted sub field drive for a projector.

FIG. 13 is a schematic showing the sub field drive pattern in this case.

In the time weighted sub field drive, gray-scale scan be reproduced by combination of sub fields whose lengths are different from each other. In the case when it is applied to a liquid crystal device, the same drive method of the above mentioned sub field drive is adopted even in the weighted sub field drive. In this drive using the time weighted sub field, the number of sub fields and the amount of combination codes that are combinations of sub fields corresponding to gray-scale in a display can be reduced. Regarding actual codes, this is obtained experimentally with gray-scale. For example, it can be obtained by the same method of forming gray-scale codes for placing emphasis on gray-scale reproducibility.

Further, the method of a weighted sub field drive can be applied not only to a liquid crystal device, but also to a device with using MEMS and a plasma display generally. In a plasma display, the characteristic of optical response is extremely good, and it is possible to implement weighting in response to bit since on and off of drive signal is almost equal to on and off of brightness. In this case, a code storing ROM is unnecessary and a pattern can be determined depending on bits of gray-scale data.

For example, in the example of FIG. 13, when it is assumed that 13/32 gray-scale (5 bits data) is displayed in a plasma display, SF1 to SF5 of FIG. 13 may become the state where SF1=on, SF2=off, SF3=on, SF4=on, SF5=on, since $13_{10}=01101_2$.

Then, in the example of FIG. 13, start timing of the pixel B is shifted by 15/31 fields, comparing with the A pixel (the shift of 15 times of the minimum sub field).

In the example of FIG. 13, the A pixel is different from the B pixel with respect to timing of black display and white display within one field period. Flickering can be reduced thereby. Here, in a weighted sub field drive method, it is necessary that timing of writing scanning is not overlapped every pixel.

Here, in the electro-optical device of the exemplary embodiment, a display mode is normally black. However, even if a display mode of an electro-optical device is normally white, the above-mentioned structure can be applied. In such a case, it is preferable that the above mentioned "on-voltage (on state)" becomes a no voltage applied state and "off-voltage (off state)" comes to be a saturated voltage, in which transmittance ratio of liquid crystal becomes the smallest.

Further, in the above mentioned exemplary embodiment, a drive device is Poly-Si (polycrystalline silicon) TFT. However, it is not limited to this. The present invention can be applied to a display element of electro-optical device (liquid crystal in the exemplary embodiment) having a structure similar to that described above, of which optical response time is longer than a sub field time or almost equal to it. Such electro optical apparatus are a projector including a liquid crystal light bulb using Poly-Si TFT as a drive device and a straight visual type liquid crystal display device using α-Si (amorphous silicon) TFT and TFD (Straight visual type LCD).

Figure 15:
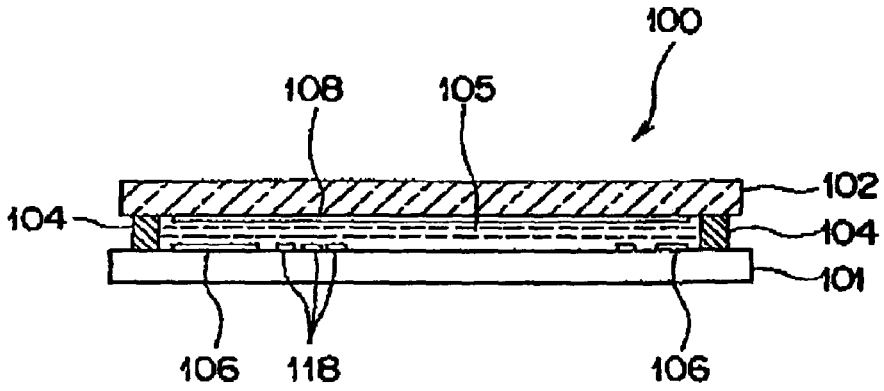
FIG. 15 is a sectional view of the A—A plane in FIG. 14.

Next, the structure of an electro-optical device related to the above-mentioned exemplary embodiment and its application is explained with reference to FIG. 14 and FIG. 15. Here, FIG. 14 is a plane view showing the structure of an electro-optical device 100 and FIG. 15 is a sectional view along plane A—A' in FIG. 14.

As shown in these figures, the electro-optical device 100 includes an element substrate 101, provided with the pixel electrode 118, an opposite substrate 102, provided with the opposite electrode 108, which are affixed together keeping a specific spacing with a seal material 104 and a liquid crystal 105 as electro-optical material which are sandwich within this spacing. Here, in practice, there is a notch part in the seal material 104, liquid crystal 105 was injected via this notch and it is sealed by a sealant. But, such illustration is omitted here.

In this exemplary embodiment, the liquid crystal visual display device, having display mode of normally black, includes a liquid crystal panel provided with combining a vertical oriented layer with liquid crystal material of negative anisotropy of electric conductivity, and this panel is sandwiched between two pieces of polarized light plates of which one light transmittance axis is shifted from another axis by 90 degrees.

The TN mode type liquid crystal being normally white display mode can also be used.

The opposite substrate 102 is a transmissive substrate such as a glass. In addition, it was described above that the element substrate 101 is a transmissive substrate. However, in case of a reflection type electro-optical device, it can be a semiconductor substrate. In this case, the pixel electrode 118 is made of reflective type metal such as aluminum since a semiconductor substrate is non-transmissive.

In the element substrate 101, a light shield layer 106 is arranged inside of the seal material 104 and outside of the display region 101*a*. Within the region where the light shield layer 106 is formed, the scanning driver 401 is formed in the region 130*a* and the data driver 500 is formed in the region 140*a*.

Specifically, the light shield layer 106 reduces or prevents light incident onto a drive circuit formed in this region. The opposite electrode voltage VLCCOM is applied to this light shield layer 106 along with the opposite electrode 108.

In addition, in the element substrate 101, plural connecting terminals are formed in a region 107 that is located outside of the region 140*a*, where the data driver 500 is formed, and apart from the sealing material 104, so that control signals and power supply from outside are supplied thereto.

On the other hand, the opposite electrode 108 of the opposite substrate 102 is electrically conducted with the conductive terminals and the light shield layer 106 on the element substrate 101 via a conductive material (not shown in the figure) which is formed at least at one position within four corners of a portion where two substrates are affixed together. Namely, the opposite electrode voltage VLCCOM is applied to the light shield layer 106 via the connecting terminals installed on the element substrate 101 and the opposite electrode 108 via the conductive material.

In addition, in the opposite substrate 102, depending on application the electro-optical device 100, for example, in the case of direct view type, firstly color filters arranged in a state of stripes, a mosaic state or a triangle state, are formed and secondly, light shielding layers (black matrix) made of metal material and/or resins are formed. Here, in case of application for chromatic light modulation, for example, in case of application for a light bulb of a projector to be described later, color filters are not used. In addition, in case of direct view type, a light source to irradiate light from the element substrate or the opposite substrate 102 is formed in the electro optical device 100, if it is necessary. Further an orientation layer (not shown in the figure), processed with rubbing toward a predetermined direction, is formed between the element substrate 101 and the electrode in the opposite substrate 102 and regulates the direction of orientation of liquid crystal molecules. A polarized light element (not shown in the figure) in response to the above orientation direction is formed on the side of the opposite substrate 102. But, if polymer dispersed liquid crystal where minute grains are dispersed in high polymer is used as the liquid crystal 105, the above mentioned orientation layer and polarized light element are not necessary so that efficiency of using light is enhanced. It is advantageous in realization of high brightness and saving energy consumption.

As an electro-optical material, electro luminescence element is used in addition to liquid crystal, and it can be applied to a display device by using its electro optical effect.

Specifically, the present invention can be applied to all electro-optical devices having the above-mentioned structure or a similar structure, especially to electro-optical devices where gray-scale is displayed by using a pixel that displays binary digits such as on and off.

Next, some examples of electronic devices using the above-mentioned liquid crystal device are explained herewith.

Figure 16:
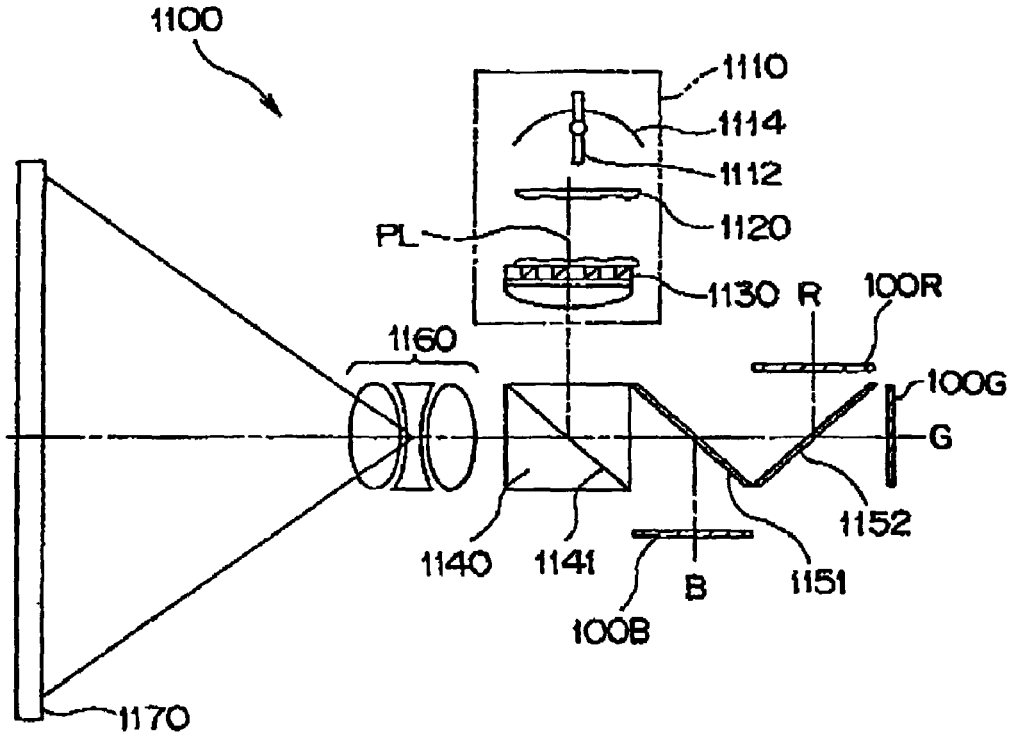
FIG. 16 is a plane view that shows constitution of a projector.

First, a projector where an electro-optical device related to the exemplary embodiment is used as a light bulb is described FIG. 16 is a plane view showing a structure of this projector. As shown in this figure, a polarized light illumination device 1110 is arranged along with a system optical axis PL in a projector 1100. In this polarized light illumination device 1110, light emitted from a lamp 1112 becomes a bundle of light rays that are generally in parallel by reflection of a reflector 1114, and are incident on a first integrator lens 1120. Hence, light emitted from the lamp 1112 is divided into plural intermediate bundles of light rays thereby. These intermediate bundles of light rays are converted into bundles of polarized light rays of one kind (bundles of s polarized light rays), of which polarized directions are generally the same, by a polarized light conversion element 1130 having a second integrator lens on the incident light side as to be emitted from the polarized light illumination device 1110.

The bundles of s polarized light rays emitted from the polarized light illumination device 1110 are reflected by a bundle of s polarized light rays reflecting surface 1141 of polarized light beam splitter 1140. Among these bundles of reflected light rays, the bundle of blue light rays (B) are reflected by a blue light reflecting layer of a dichroic mirror 1151 and modulated by a reflection type electro-optical device 100B. Further, among the bundle of light rays transmitted through the blue light reflecting layer of the dichroic mirror 1151, the bundle of red light rays (R) are reflected by the red light reflection layer of the dichroic mirror 1152 and modulated by a reflection type electro-optical device 100R.

However, among the bundle of light rays transmitted through the blue light reflecting layer of the dichroic mirror 1151, the bundle of green light rays (G) are transmitted through red light reflecting layer of the dichroic mirror 1152 and modulated by a reflection type electro-optical device 100G.

In this way, each of red, green, and blue lights that are modulated chromatically by the electro-optical devices 100R, 100G, 100B are integrated in order by the dichroic mirrors 1152, 1151 and polarized light beam splitters 1140. Then they are projected onto a screen 1170 by a projection optical system 1160 thereafter. Here, a color filter is not necessary since the bundles of light rays corresponding to primitive color lights R, G and B are incident on the electro-optical devices 100R, 100B and 100G by the dichroic mirrors 1151, 1152.

Further, in the present exemplary embodiment, a reflection type electro-optical device is used, but a projector using a transmissive type electro-optical device may be appropriate too.

Figure 17:
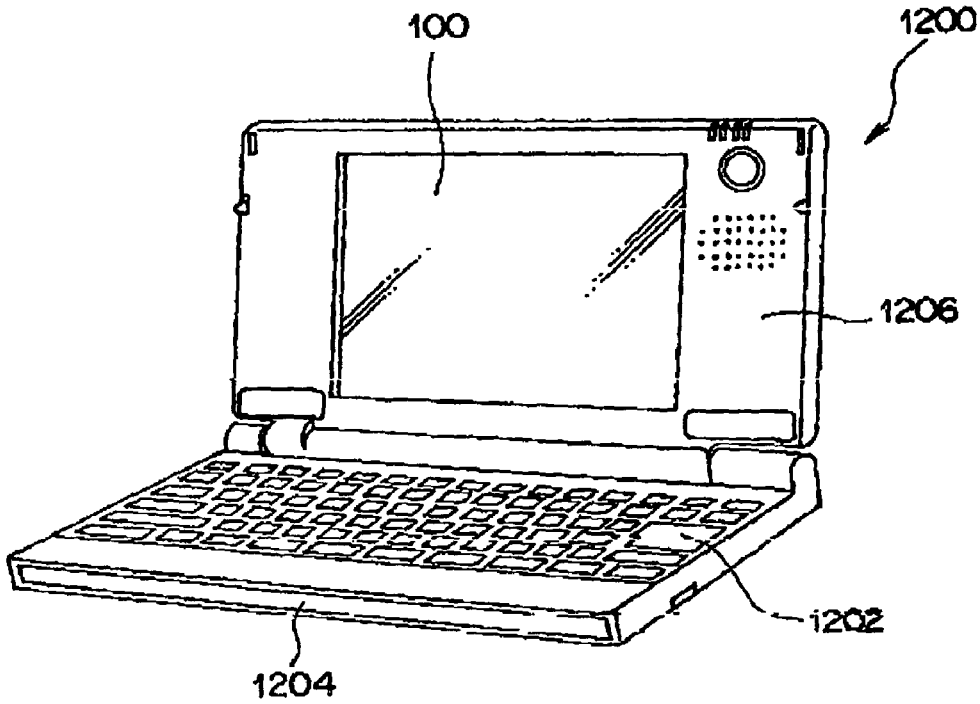
FIG. 17 is a perspective schematic that shows constitution of a personal computer.

Next, an example where the above mentioned electro optical device is applied to a mobile type personal computer is described. FIG. 17 is a perspective schematic showing the structure of this personal computer. In this figure, a computer 1200 includes a main body portion 1204 provided with a keyboard 1202 and a display unit 1206. This display unit 1206 is provided with a front light in the front of the above-mentioned electro-optical device 100.

Here, according to this structure, the electro-optical device 100 is used as a reflected straight view type so that unevenness is preferably formed on the pixel electrode 118 in order to scatter reflected light to various directions.

Figure 18:
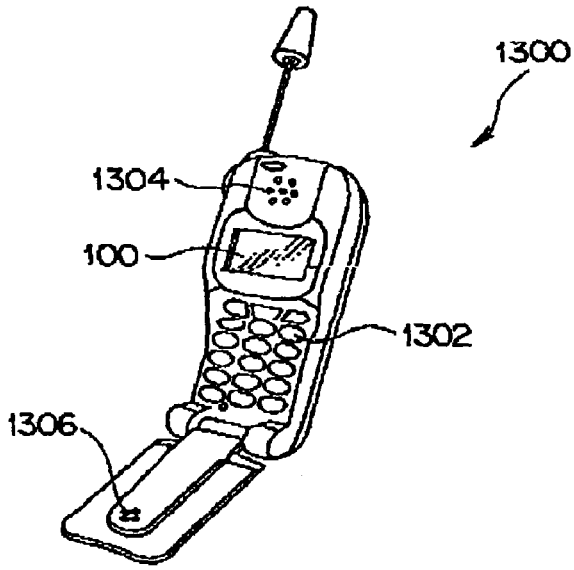
FIG. 18 is a perspective schematic that shows constitution of a cellular phone.

Furthermore, an example where the electro-optical device is applied to a cellular phone is described. FIG. 18 is a perspective schematic that shows the structure of the cellular phone. In this figure, a cellular phone 1300 includes a plural operational buttons 130, an ear piece 1304, a mouth piece 1306 and the electro-optical device 100.

In this electro-optical device 100, a front light is provided in front, if necessary. Further, even in this structure, the electro-optical device 100 is used as a reflective straight view type so that unevenness is preferably formed on the pixel electrode 118.

Further, as electronic devices, except as described above with reference to FIG. 17, FIG. 18, a liquid crystal TV, a view finder type or monitor direct-view type video tape recorder, a navigation unit for an automobile, a pager, an electronic note, an electronic calculator, a word processor, a work station, a TV telephone, POS terminals, apparatus including a touch panel and so on, are considered. Further, the above-mentioned exemplary embodiments and their applications can be surely applied to these various types of electronic devices.

As discussed above, according to the present invention, it is advantageous in that image quality is improved by reducing flickering due to differentiating timing of blinking of each of the adjacent pixels.

The invention claimed is:

1. A drive circuit for an electro-optical device, including a display portion having pixels arranged in a matrix and having a light transmittance ratio changed by applying voltage, supplying on-voltage to make the light transmittance ratio be saturated, or off-voltage to make the light transmittance ratio be a non-transmissive state to the display portion, and implementing sub field drive to realize gray-scale display in response to a ratio of an optical transmissive state to a non-transmissive state of the electro-optical material per unit time, comprising:

a first pixel driving device, driving each of the pixels with each sub field as a unit of control that is formed by dividing a field into plural portions on a time axis, and driving one of the pixels located at a predetermined position in an image by a first sub field drive pattern that is an arranged pattern of a sub field of applying the off-voltage and a sub field of applying the on-voltage;

a second pixel driving device, driving the pixel with each sub field as a unit of control that is formed by dividing a field into plural portions on a time axis, and driving another of pixels adjacent to the pixel located at the predetermined position in an image by an least one second sub field drive pattern differentiated from the first sub field drive pattern; and a timing of starting a field to supply the on-voltage or the off-voltage to the pixel is shifted regarding each adjacent pixel.

2. The drive circuit for an electro-optical device according to claim 1, the second pixel driving device, driving the another pixel adjacent to the pixel located at the predetermined position in an image with the second sub field drive pattern by starting sub field drive based on the first sub field drive pattern, by differentiating the start timing by term of integral multiple of a sub field period from start timing of the sub field drive to the pixel located at a predetermined position in an image by the first driving device.

3. The drive circuit for an electro-optical device according to claim 1, the second sub field drive pattern being obtained by delaying the first sub field drive pattern by a predetermined number of sub field periods on a time axis.

4. The drive circuit for an electro-optical device according to claim 1, the first and the second sub field drive patterns being stored in a memory.

5. The drive circuit for an electro-optical device according to claim 1, the first and the second pixel driving devices driving each of the pixels with a control area unit of predetermined numbers of pixels by using the first and the second sub field drive patterns.

6. The drive circuit for an electro-optical device according to claim 1, the first and the second pixel driving devices applying the on-voltage to the electro-optical material during the sub field period at the former end part of the field period intensively.

7. The drive circuit of an electro-optical device according to claim 1, the first and second pixel drive devices applying the off-voltage to pixels during the sub field period at the latter end part of the field period intensively.

8. The drive circuit of an electro-optical device according to claim 1, a plurality of sub fields within each field being set to have the almost equivalent time width.

9. The drive circuit of an electro-optical device according to claim 1 a plurality of sub fields within each field being set to have plural different time widths.

10. An electro-optical device being provided with the driving circuit of an electro-optical device according to claim 1.

11. An electronic apparatus being provided with the electro-optical device according to claim 10.

12. The drive circuit of an electro-optical device according to claim 1, a sub field drive pattern is changed in order to differentiate timing flickering every unit of a predetermined display area regarding adjacent pixels.

13. A drive circuit for an electro-optical device, including a display portion having pixels arranged in a matrix and having a light transmittance ratio changed by applying voltage, supplying on-voltage to make the light transmittance ratio be saturated, or off-voltage to make the light transmittance ratio be a non-transmissive state to the display portion, and implementing sub field drive to realize gray-scale display in response to a ratio of an optical transmissive state to a non-transmissive state of the electro-optical material per unit time, comprising:

a first pixel driving device, driving each of the pixels with each sub field as a unit of control that is formed by dividing a field into plural portions on a time axis, and driving one of the pixels located at a predetermined position in an image by a first sub field drive pattern that is an arranged pattern of a sub field of applying the off-voltage and a sub field of applying the on-voltage;

a second pixel driving device, driving the pixel with each sub field as a unit of control that is formed by dividing a field into plural portions on a time axis, and driving another of pixels adjacent to the pixel located at the predetermined position in an image by at least one second sub field drive pattern differentiated from the first sub field drive pattern; and the first and the second pixel driving devices setting the sub field period to be shorter than saturation response time when transmittance ratio of the pixels is saturated in response to the applied on-voltage.

14. A drive circuit for an electro-optical device, including a display portion having pixels arranged in a matrix and having a light transmittance ratio changed by applying voltage, supplying on-voltage to make the light transmittance ratio be saturated, or off-voltage to make the light transmittance ratio be a non-transmissive state to the display portion, and implementing sub field drive to realize gray-scale display in response to a ratio of an optical transmissive state to a non-transmissive state of the electro-optical material per unit time, comprising:

a first pixel driving device, driving each of the pixels with each sub field as a unit of control that is formed by dividing a field into plural portions on a time axis, and driving one of the pixels located at a predetermined position in an image by a first sub field drive pattern that is an arranged pattern of a sub field of applying the off-voltage and a sub field of applying the on-voltage;

a second pixel driving device, driving the pixel with each sub field as a unit of control that is formed by dividing a field into plural portions on a time axis, and driving another of pixels adjacent to the pixel located at the predetermined position in an image by at least one second sub field drive pattern differentiated from the first sub field drive pattern; and the first and the second pixel driving devices setting the sub field period to be shorter than non-transmissive response time when transmittance ratio of the pixels is transferred from a saturated state to a non-transmissive state in response to the applied off-voltage.

15. A drive circuit for an electro-optical device, including a display portion having pixels arranged in a matrix and having a light transmittance ratio changed by applying voltage, supplying on-voltage to make the light transmittance ratio be saturated, or off-voltage to make the light transmittance ratio be a non-transmissive state to the display portion, and implementing sub field drive to realize gray-scale display in response to a ratio of an optical transmissive state to a non-transmissive state of the electro-optical material per unit time, comprising:

a first pixel driving device, driving each of the pixels with each sub field as a unit of control that is formed by dividing a field into plural portions on a time axis, and driving one of the pixels located at a predetermined position in an image by a first sub field drive pattern that is an arranged pattern of a sub field of applying the off-voltage and a sub field of applying the on-voltage;

a second pixel driving device, driving the pixel with each sub field as a unit of control that is formed by dividing a field into plural portions on a time axis, and driving another of pixels adjacent to the pixel located at the predetermined position in an image by at least one second sub field drive pattern differentiated from the first sub field drive pattern; and the first and the second pixel driving devices applying the on-voltage to pixels during continuous or discontinuous sub fields so that an integral value of the transmissive state of the pixels in the field period in response to display data.

16. A method of driving an electro-optical device including a display portion having pixels arranged in a matrix and having a light transmittance ratio changed by applying voltage, supplying on-voltage to make the light transmittance ratio be saturated, or off-voltage to make the light transmittance ratio be a non-transmissive state to the display portion, and implementing sub field drive to realize gray-scale display in response to the ratio of an optical transmissive state to a non-transmissive state of the electro-optical material per unit time, comprising:

driving the pixel with each sub field as a unit of control that is formed by dividing a field into plural portions on a time axis and driving the pixel located at a predetermined position in an image by a first sub field drive pattern that is an arranged pattern of a sub field of applying the off-voltage and a sub field of applying the on-voltage;

driving the pixel with a sub field as a unit of control that is formed by dividing a field into plural portions on a time axis and driving a pixel adjacent to the pixel located at a predetermined position in an image by at least one second sub field drive pattern differentiated from the first sub field drive pattern; and a timing of starting a field to supply the on-voltage or the off-voltage to the pixel is shifted regarding each adjacent pixel.

17. A method of driving an electro-optical device including a display portion having pixels arranged in a matrix and having a light transmittance ratio changed by applying voltage, supplying on-voltage to make the light transmittance ratio be saturated, or off-voltage to make the light transmittance ratio be a non-transmissive state to the display portion, and implementing sub field drive to realize gray-scale display in response to the ratio of an optical transmissive state to a non-transmissive state of the electro-optical material per unit time, comprising:

driving the pixel with each sub field as a unit of control that is formed by dividing a field into plural portions on a time axis and driving the pixel located at a predetermined position in an image by a first sub field drive pattern that is an arranged pattern of a sub field of applying the off-voltage and a sub field of applying the on-voltage;

driving the pixel with a sub field as a unit of control that is formed by dividing a field into plural portions on a time axis and driving a pixel adjacent to the pixel located at a predetermined position in an image by at least one second sub field drive pattern differentiated from the first sub field drive pattern; and the first and the second pixel driving devices setting the sub field period to the shorter than saturation response time when transmittance ratio of the pixels is saturated in response to the applied on-voltage.

18. A method of driving an electro-optical device including a display portion having pixels arranged in a matrix and having a light transmittance ratio changed by applying voltage, supplying on-voltage to make the light transmittance ratio be saturated, or off-voltage to make the light transmittance ratio be a non-transmissive state to the display portion, and implementing sub field drive to realize gray-scale display in response to the ratio of an optical transmissive state to a non-transmissive state of the electro-optical material per unit time, comprising:

driving the pixel with each sub field as a unit of control that is formed by dividing a field into plural portions on a time axis and driving the pixel located at a predetermined position in an image by a first sub field drive pattern that is an arranged portion of a sub field of applying the off-voltage and a sub field of applying the on-voltage;

driving the pixel with a sub field as a unit of control that is formed by dividing a field into plurality portions on a time axis and driving a pixel adjacent to the pixel located at a predetermined position in an image by at least one second sub field drive pattern differentiated from the first sub field drive pattern; and the first and the second pixel driving device setting the sub field period to be shorter than non-transmissive response time when the transmittance ratio of the pixels is transferred from a saturated state to a non-transmissive state in response to the applied off-voltage.

19. A method of driving an electro-optical device including a display portion having pixels arranged in a matrix and having a light transmittance ratio changed by applying voltage, supplying on-voltage to make the light transmittance ratio be saturated, or off-voltage to make the light transmittance ratio be a non-transmissive state to the display portion, and implementing sub field drive to realize gray-scale display in response to the ratio of an optical transmissive state to a non-transmissive state of the electro-optical material per unit time, comprising:

driving the pixel with each sub field as a unit of control that is formed by dividing a field into plural portions on a time axis and driving the pixel located at a predetermined position in an image by a first sub field drive pattern that is an arranged pattern of a sub field of applying the off-voltage and a sub field of applying the on-voltage;

driving the pixel with a sub field as a unit of control that is formed by dividing a field into plurality portions on a time axis and driving a pixel adjacent to the pixel located at a predetermined position in an image by at least one second sub field drive pattern differentiated from the first sub field drive pattern; and the first and second pixel driving device apply the on-voltage to the pixels during continuous or discontinuous sub fields so that an integral value of the transmissive state of the pixels in the field period is in response to display data.

* * * * *